US005810489A

United States Patent [19]

Nakagaki et al.

[11] Patent Number: 5,810,489

[45] Date of Patent: Sep. 22, 1998

[54] PRINTING TYPE PRINTER

[75] Inventors: Yuji Nakagaki; Fumio Otsuka; Hiroyuki Harada; Akio Tajima, all of Tokyo, Japan

[73] Assignee: Seiko Precision Inc., Tokyo, Japan

[21] Appl. No.: 539,910

[22] Filed: Oct. 6, 1995

[30] Foreign Application Priority Data

| | | | |
|---|---|---|---|
| Oct. 7, 1994 | [JP] | Japan | 6-244154 |
| Oct. 7, 1994 | [JP] | Japan | 6-244155 |
| Oct. 7, 1994 | [JP] | Japan | 6-244156 |
| Dec. 6, 1994 | [JP] | Japan | 6-302197 |
| Dec. 20, 1994 | [JP] | Japan | 6-316818 |
| Mar. 9, 1995 | [JP] | Japan | 7-049410 |

[51] Int. Cl.[6] ..... B41J 1/46

[52] U.S. Cl. ..... 400/152; 400/171; 400/175

[58] Field of Search ..... 400/152, 171, 400/175, 148, 172, 151

[56] References Cited

U.S. PATENT DOCUMENTS

| | | | |
|---|---|---|---|
| 3,279,576 | 10/1966 | Howard | 400/148 |
| 3,892,303 | 7/1975 | Willcox | 400/172 |
| 4,208,140 | 6/1980 | Bucknam | 400/171 |
| 4,281,938 | 8/1981 | Phillips | 400/171 |
| 4,289,412 | 9/1981 | Dollenmayer | 400/171 |
| 4,307,968 | 12/1981 | Habich et al. | 400/171 |
| 4,961,655 | 10/1990 | Saito | 400/171 |
| 5,193,923 | 3/1993 | Kondo et al. | 400/171 |

*Primary Examiner*—Eugene H. Eickholt
*Attorney, Agent, or Firm*—Amster, Rothstein & Ebenstein

[57] ABSTRACT

The present invention is intended to facilitate the replacement of printing types and to eliminate mistakes in the replacement thereof. A printing type wheel 2 and a stock wheel 3 are coaxially arranged. The printing type wheel 2 is provided with an attachment part for inserting and attaching a printing type unit 5 for printing on an object F to be printed. The printing type unit 5 is detachably stocked in the stock wheel 3. The printing type unit 5 is taken out from the stock wheel 3 with a robot 6 so as to be attached on the printing type wheel 2. Ink is deposited to the printing type unit 5 attached on the printing type wheel 2 with an ink roller 45. The printing type wheel 5, the stock wheel 3 and the ink roller 45 are warmed with the heater 30 and the heater 46.

60 Claims, 23 Drawing Sheets

PRINTING TYPE PRINTER

BACKGROUND OF THE INVENTION

1. Field of the Invention

The present invention relates to a printing type printer, and more particularly to a printing type printer for printing a date of manufacture on product packaging.

2. Description of the Prior Art

A conventional printing type printer is individually provided with a printing type stock for constantly stocking characters and symbols to be printed, and a printing type wheel in which characters and symbols to be printed can be attached wherein a necessary printing type is picked out from the printing type by hands at the time of printing so that the printing type is attached on a printing type wheel and printed on a package in the subsequent process.

A printing type printer for printing on a product package prior to packaging is normally incorporated in part of a packaging machine. The package which has passed through the printing process is subsequently conveyed to a packaging part for packaging the product. Consequently, since the printed ink has to be swiftly coagulated, thermally melting type ink is used as the ink. The ink is kept at a predetermined temperature which is higher than the melting point (about 70° C.) and the printing type wheel is also kept at a high temperature for printing. During the printing process, it is sometimes necessary to change the printing type which takes extra time because the printing type wheel is kept at high temperatures that cannot be replaced by hand until cooled. The ink and printing type must then be heated up again before printing can proceed. Therefore, this procedure takes extra time. In addition, since the printing types are replaced by hand, a wrong printing type may be detached by mistake.

Therefore, an object of the present invention is to facilitate the expeditious replacement of printing types and to eliminate a mistake in the replacement of printing types.

BRIEF SUMMARY OF THE INVENTION

To resolve the aforementioned problem, the printing type printer of the present invention has a printing type wheel provided with a printing type attachment part having a detachable printing type unit for printing characters and symbols on a matter to be printed, a stock wheel for detachably stocking said printing type unit attached on said printing type wheel, and a robot which attaches said printing type unit on said printing type wheel by taking out said printing type unit from said stock wheel.

The printing type wheel and the stock wheel are preferably coaxially arranged. In such a case, the printing type wheel and the stock wheel are more preferably integrally arranged in a row.

Furthermore, the printing type wheel and the stock wheel are preferably sectioned on the perimeter of the same wheel.

Preferably, the printing type wheel is provided with either a first printing type attachment part attached with a perpendicular typing printing type unit for printing characters and symbols on said matter to be printed in such a manner that a direction perpendicular to a conveyance direction of said printed characters and symbols is printed in a right and left direction or a second printing type attachment part attached with a printing type unit for a flow printing for printing characters and symbols on said matter to be printed in such a manner that the conveyance direction of said character and symbols is printed in a right and left direction.

The main body of the printing type unit comprises a projecting part exposed from the printing type attachment part of the printing type wheel, and an insertion part inserted into a printing type attachment part of the printing type wheel. On the top of the projecting part, a printing type surface such as characters and symbols to be printed is provided. On the side of the projecting part, a gripping part is provided for attaching the detachably printing type unit on the printing type attachment part of the printing type wheel. Inside of the main body of the printing type unit, a housing chamber is provided for housing a holding means for engaging and holding the printing type unit in the printing type attachment part. Preferably, the holding means comprises an engagement part engaged with a printing type attachment part of the printing type wheel, and a spring member for energizing the engagement part in an engagement direction with the printing type attachment part of the printing type wheel. In such a case, the engagement part of the holding means comprises an engagement projecting part outwardly projected in an intermediate part of a pair of engagement pieces located opposite to each other with a predetermined interval. In an opposite surface of the intermediate part of the engagement piece, a recessed part is provided. A spring member is positioned and held in the recessed part to energize the pair of engagement pieces in a repelling direction. On the upper end of the engagement piece, an operation projecting part is provided for receiving pressure force from the outside in the gripping part. The printer may be constituted such that when the engagement piece oscillates upon the operation projecting part, pressure force is provided on the lower end of the engagement piece. In addition, the engagement part of the holding means comprises an engagement hook part projectingly provided to the outside on the lower end of the pair of engagement pieces oscillatingly supported at the intermediate part. A central axis penetrates the intermediate part of the engagement piece which constitutes the center of oscillation. On the upper end of the engagement piece, an operation projecting part is provided which receives pressure force from the outside in the gripping part. The spring member is fit and supported in the central shaft. At the same time, the printing type printer may be constituted so that both ends of the spring member are respectively engaged in the lower end of the engagement piece, and the pair of the engagement hooks may be constituted so as to be energized in a repelling direction. Further, the engagement part of the holding means comprises an engagement projecting part deflected to be projected in a mutually opposite direction in the vicinity of both ends of the spring member. Both ends of the spring member are engaged in a restraint piece projectingly provided on the upper end of the housing chamber. A winding part in the middle of the spring member is fit and supported on a shaft part projectingly provided on a lower end of the housing chamber with the result that the printing type printer may be constituted so that a pair of engagement projecting part is energized in a repelling direction.

Further, the printing type printer is preferably provided with an ink roller supplying ink to a printing type unit attached in the printing type wheel and a movement driving means for moving the ink roller in a direction parallel to the axial direction of the printing type wheel. In such a case, a removal port is provided which enables the removal of the ink roller on a support plate facing one end of the ink roller. Further, the movement driving means is preferably driven in synchronization with the rotation driving means of the printing type wheel.

In addition to an ink roller for supplying ink to the printing type unit, it is preferable that a separation driving means is provided for separating the ink roller from the printing type unit at the time of the exchange of the printing type unit. In this case, the separation driving means may serve to separate the ink roller in the axial direction of the printing type wheel. In the alternative, the separation driving means may serve to separate the ink roller in the radial direction of the printing type wheel. Further, in the case where the separation driving means serves to separate the ink roller in the axial direction of the printing type wheel, the separation driving means preferably also serves the function of changing a contact position of the printing type unit and the ink roller at the time of printing characters and symbols on a matter to be printed. Further, it is desirable that the separation driving means also serves the function of moving the ink roller to a predetermined position at the time of the exchange.

Further, preferably, a control means is provided for controlling a rotation driving means of the printing type wheel so that the printing type unit rotates in synchronization with the conveyance speed of the matter to be printed while the printing type unit contacts the matter to be printed and the printing type wheel consecutively rotates at a speed either faster or slower than the conveyance speed of the matter to be printed while the printing type unit separates from the object to be printed.

Since the printing type printer of the present invention has a printing type wheel provided with a printing type attachment part having a detachable printing type unit for printing characters and symbols on a matter to be printed, a stock wheel for detachably stocking said printing type unit attached on said printing type wheel, and a robot which is attached on said printing type wheel by taking out said printing type unit from said stock wheel, an operation of detaching the printing type unit from the stock wheel and attaching the unit into the printing type wheel is performed by the robot. The replacement of the printing type can be easily and quickly performed. Besides, an error in the replacement thereof can be eliminated. Further, by coaxially arranging the printing type wheel and the stock wheel, the driving means of the robot can be facilitated. Consequently, the driving means of the robot can be manufactured in a small size. Further, by coaxially and integrally arranging the printing type wheel and the stock wheel in a row, a heater that can be used for warming the driving motor of the printing type wheel and the stock wheel as well as the printing type wheel and the stock wheel can be commonly used so that the number of parts and the cost can be reduced. Further, by providing the printing type wheel and the stock wheel on the same circumferential surface of the same wheel through sectioning the surface, the stroke for moving the robot can be reduced along with the aforementioned advantage. Consequently, the space in the axial direction can be reduced.

Further, by providing a first printing type attachment part attached with a printing type unit for vertical typing and a second printing type attachment part attached with a printing type unit for flow typing, either the printing type unit for vertical typing or the printing type unit for flow typing can be selectively attached on the printing type wheel so that characters and symbols can be printed by changing the direction of these characters and symbols. Consequently, the number of parts can be reduced, and the cost reduction can be attained. Further, since the replacement of the printing type wheel is not needed, the work can be facilitated.

In addition, on a projecting part exposed from the printing type attachment part of the main body of the printing type unit, a gripping part for detachment is provided. The holding means housed in the housing chamber provided inside of the main body is constituted of an engagement part and a spring member for energizing this engagement part with the result that the printing type unit can be smoothly attached and detached with the spring force of the spring member only by inserting or pulling out through the gripping part and can be engaged and held in the printing type attachment part safely and securely with the engagement part. In this manner, the detachment of the printing type unit can be facilitated and heightened in speed of operation. Further, with respect to the holding means, the insertion part can be reduced in size with a simple structure. In addition, the main body of the printer can be reduced in size.

Further, the ink contained in the ink roller can be uniformly consumed with a subsequent change in the contact position of the ink roller with the printing type unit by providing a movement driving means for moving the ink roller in parallel with the axial direction of the printing type wheel. Thus, non-uniformity in ink is not generated and the life of the ink roller can be prolonged. Then the replacement of the ink roller can be facilitated by providing a detachment port which enables detachment of the ink roller on the support plate which faces one end of the ink roller. Further, the consumption of the ink can be applied in a more uniform manner by driving the movement driving means in synchronization with the rotation driving means of the printing type wheel, thereby preventing the non-uniformity of ink.

Further, the ink is not deposited on the printing type unit while the printing type wheel is rotating at the time of the replacement of the printing type unit because a separation driving means is used for separating the ink roller from the printing type unit at the time of the replacement of the printing type unit. Consequently, the waste of the ink can be eliminated and the life of the ink supply means can be prolonged. In addition, the print surface is kept clean even when the printing operation is resumed after the replacement of the printing type unit.

Further, the printing type wheel can be continuously rotated and driven through the change in the rotation speed of the printing type wheel by providing control means for controlling the rotation driving means of the printing type wheel so that the printing type wheel rotates in synchronization with the conveyance speed of the object to be printed while the printing type unit contacts the object to be printed so that the printing type wheel rotates at a speed either faster or slower than the conveyance speed of the object to be printed while the printing type unit is separated from the object to be printed. Consequently, the life of the driving motor can be prolonged as compared to a conventional example in which the driving motor is temporarily suspended. Further, since the rise and fall of the motor is not needed, the printing pitch can be set to a shorter level by that portion. The oscillation of the motor can be eliminated. Further, the printing pitch can be set to any level irrespective of the circumferential length of the printing type wheel. In addition, characters and symbols can be surely printed at all times at a predetermined position.

DETAILED DESCRIPTION OF THE PREFERRED EMBODIMENTS

Figure 1:
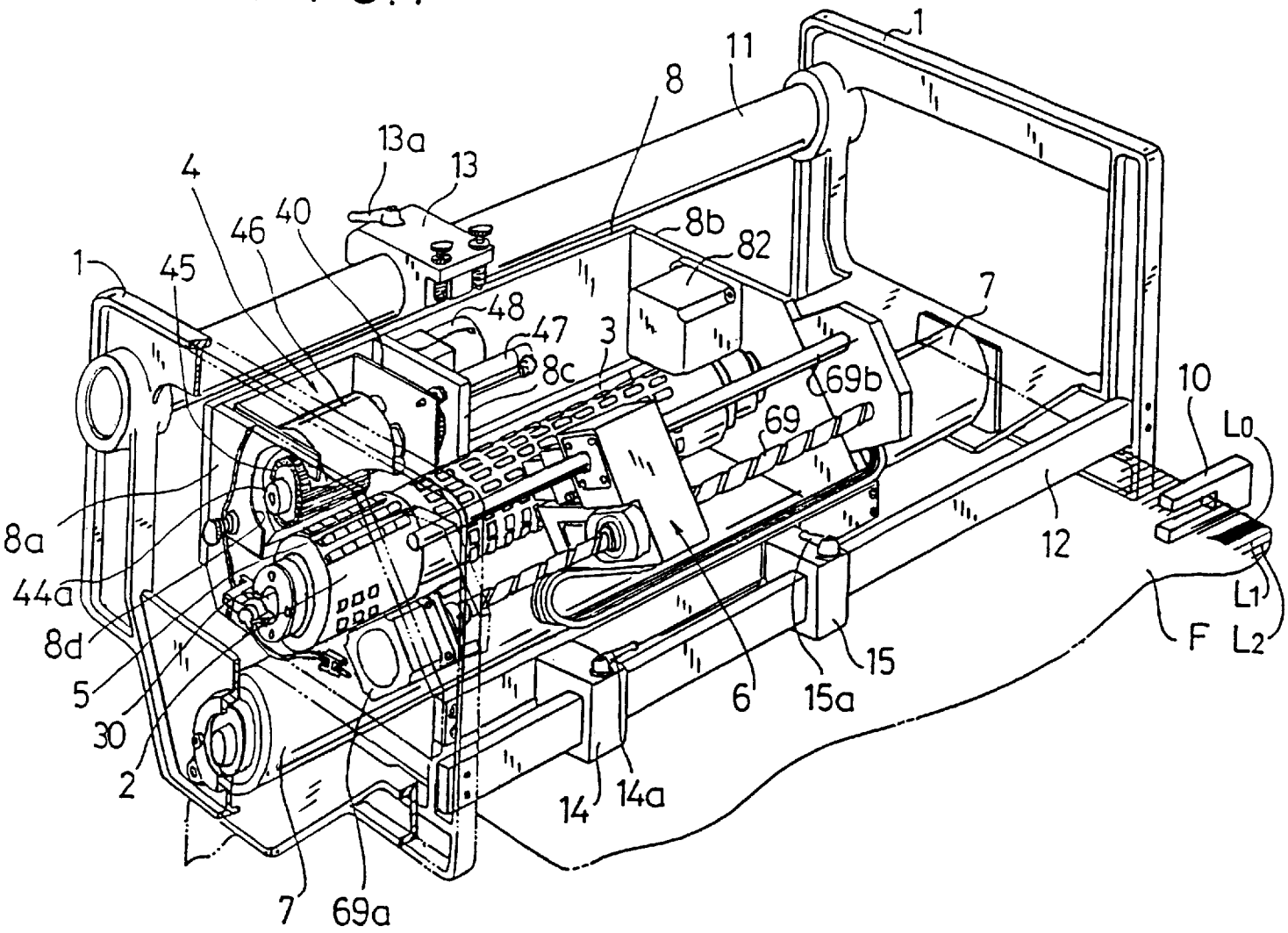
FIG. 1 is a perspective view showing the entire printing type printer according to one embodiment of the present invention.

One embodiment of the present invention will be explained in detail by referring to the drawings.

FIG. 1 shows an overall structure of the printing type printer of the present invention. In a packing machine not shown, side plates 1 and 1 are fixed with a predetermined interval. With these side plates, the printing type printer of the present invention is attached. In the printing type printer according to the embodiment, a stock wheel 3 for stocking a printing type unit 5 has a drum shaped configuration smaller than the printing type wheel 2 and is attached on the printing type wheel 2 so as to be coaxially and integrally arranged in a row. Further, a robot 6 for taking out a necessary printing type unit 5 from the stock wheel 3 to be attached in the printing type wheel 2 is provided so that the robot 6 can move between the printing type wheel 2 and the stock wheel 3. Further, an ink roller unit 4 for supplying ink to the printing type unit 5 attached on the printing type wheel 2 is provided adjacent to the printing type wheel 2, and a platen 7 is arranged opposite to the printing type wheel 2.

With the side plates 1 and 1, both ends of each of the guide rod 11 and the guide bloc 12 are supported. A support frame 8 of the printing type printer is fixed in a position by adjustment members 13, 14 and 15 which slidably fit into the guide rod 11 and the guide bloc 12. Since a gap between the side walls 8*a* and 8*b* of the support frame 8 is set to a width narrower than a gap between the side plates 1 and 1, the position adjustment members 13, 14 and 15 can be slidably moved in the right and left direction when lock levers 13*a*, 14*a* and 15*a* are relaxed. The printing position of the printing type printer can be adjusted by fastening the lock levers. This printing type printer enables two types of typing, a so-called vertical typing in which an object to be printed such as characters and symbols are printed on a package F in such a manner that a direction vertical to the conveyance direction of the package F is printed in a right and left direction, and a so-called flow typing in which such characters and symbols are printed in such a manner that the conveyance direction of the package F is printed in a right and left direction.

Figure 2:
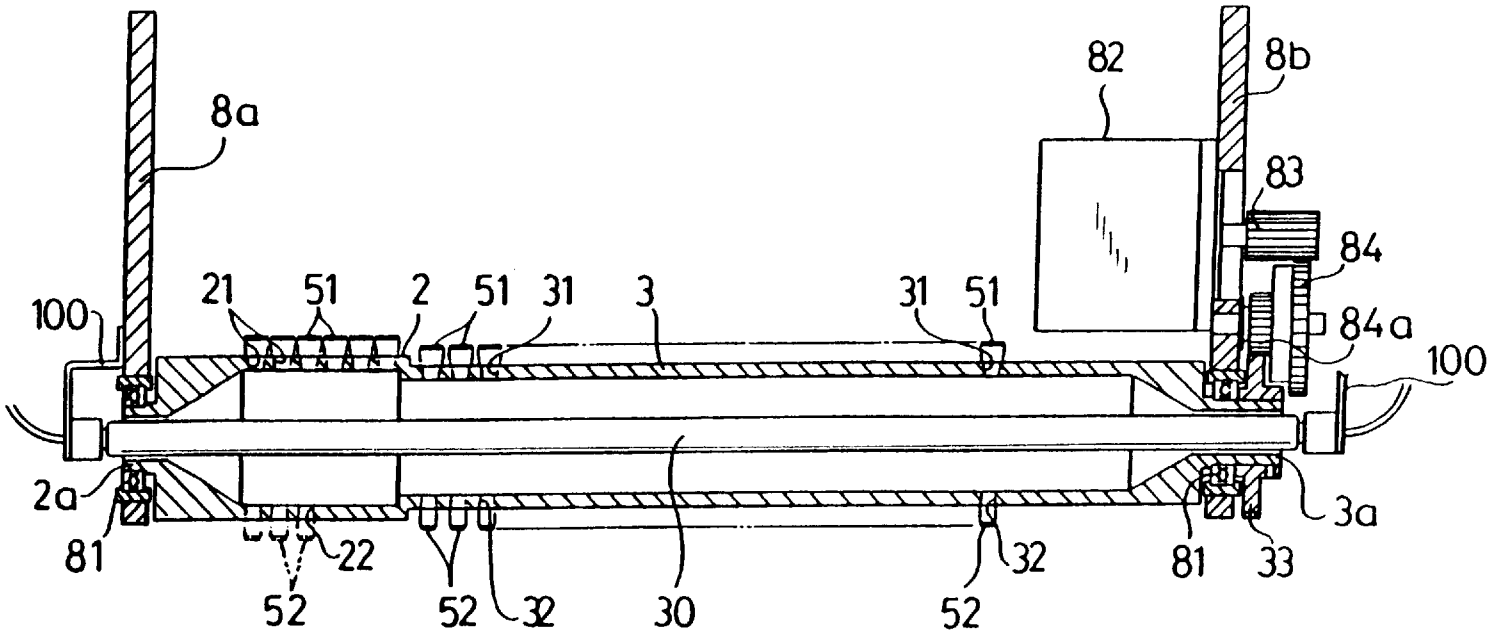
FIG. 2 is an expanded sectional view showing a printing type wheel and a stock wheel.
Figure 3:
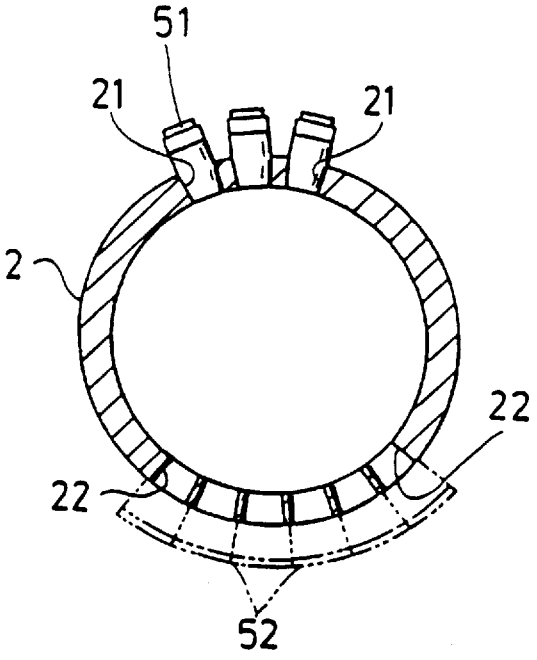
FIG. 3 is an expanded sectional view showing a printing type wheel.
Figure 4:
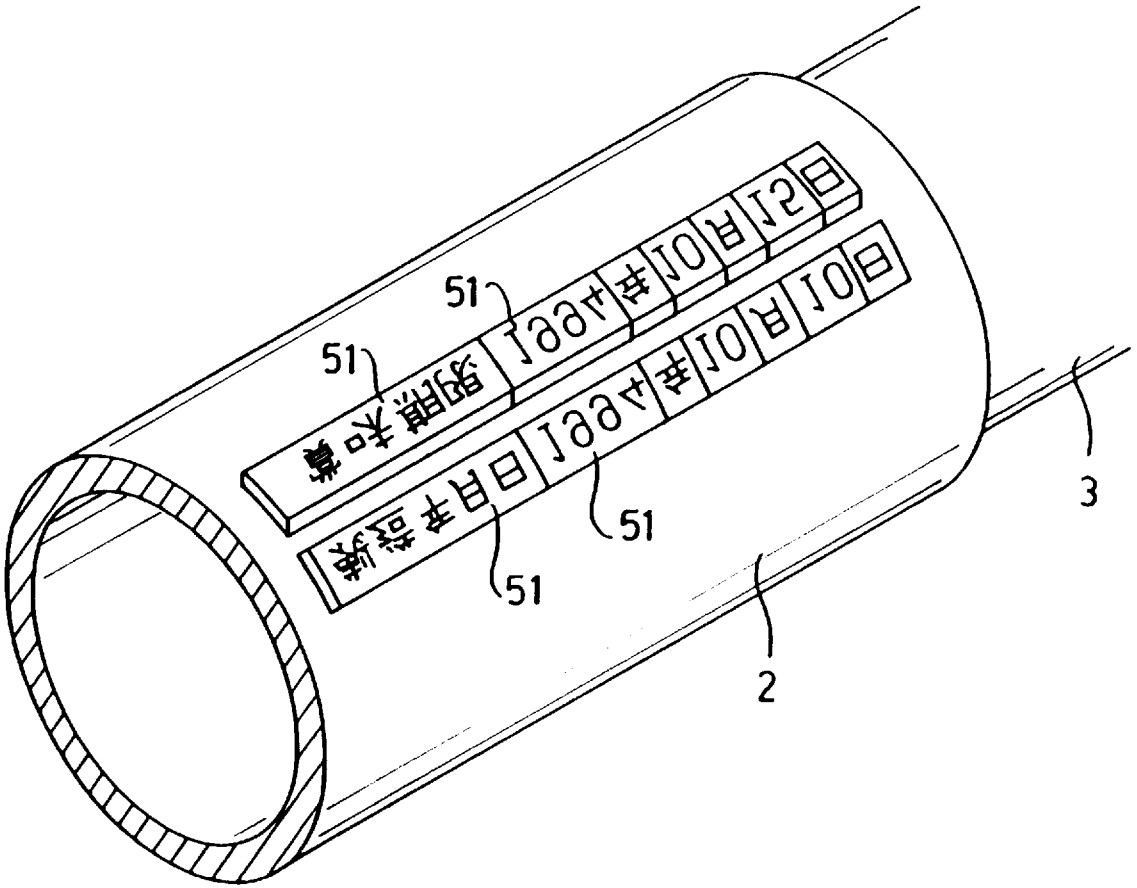
FIG. 4 is a perspective view showing a state in which a printing type unit for vertical typing is attached on the printing type wheel.
Figure 5:
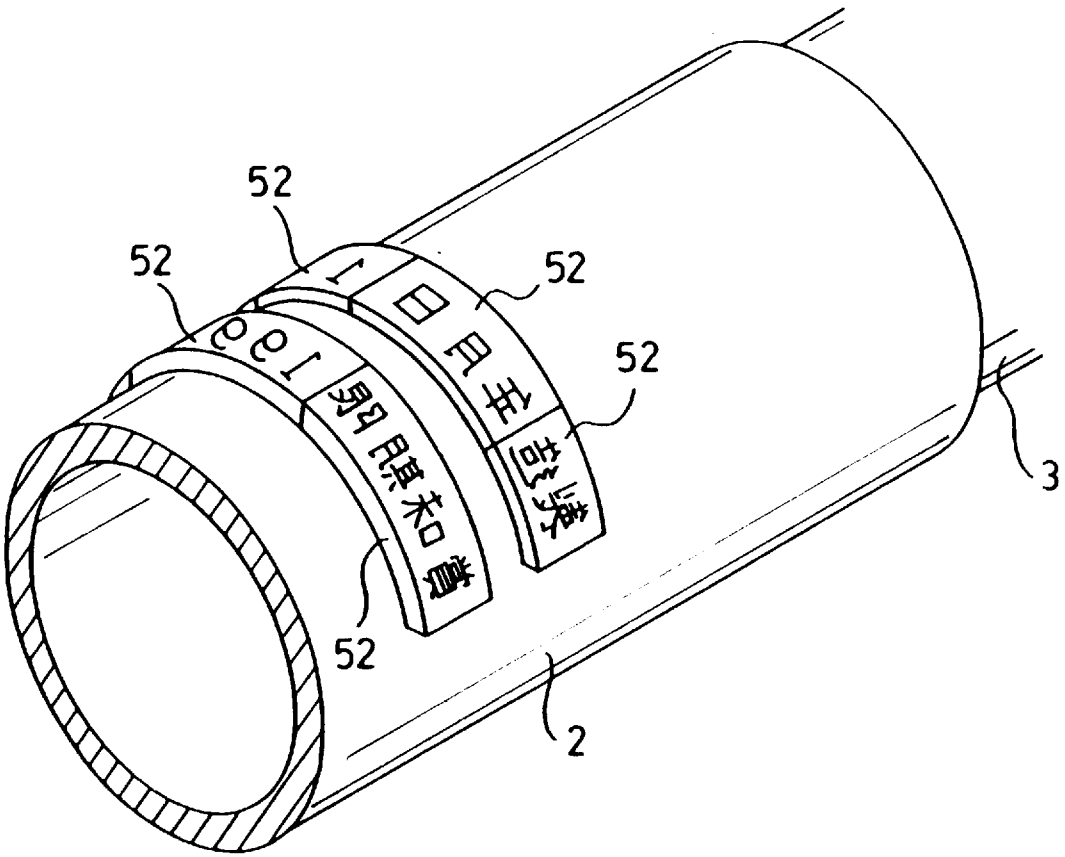
FIG. 5 is a perspective view showing a state in which the printing type unit for flow typing is attached on the printing type wheel.

As shown in FIG. 2, the printing type wheel 2 and the stock wheel 3 coaxially and integrally arranged in a row are rotatably supported on side walls 8*a* and 8*b* of the support frame 8 via a ball bearing 81 with wheel shaft parts 2*a* and 3*a* at both ends. On the printing type unit 5, there is provided a printing type unit 51 for the aforementioned vertical printing and a printing type unit 52 for the aforementioned flow printing. These printing type units are constituted in such a manner that the direction of the printing type in the attachment state of the printing type unit on the printing type wheel 2 is different as shown in FIGS. 4 and 5. Either of these printing type units 51 and 52 are selectively attached on the printing type wheel 2 to enable the vertical typing or the flow typing selectively when needed. (see FIGS. 4 and 5) Consequently, the printing type wheel 2 is provided with a first printing type attachment part 21 attached with the printing type unit 51 and a second printing type attachment part 22 attached with the printing type unit 52. The stock wheel 3 is provided with printing type attachment parts 31 and 32 for stocking the printing type unit 51 and the printing type unit 52, respectively, at predetermined positions.

The printing type wheel 2, the stock wheel 3 and the wheel shaft parts 2*a* and 3*a* have hollow configurations. A rod-like heater 30 that enables heating both wheels at the same time penetrates the hollow part. Both ends of the heater 30 is fixed to the side walls 8*a* and 8*b* via an attachment member 100 and is connected to a power source not shown.

To rotate and drive the printing type wheel 2 and the stock wheel 3, a driving gear 33 is fixed to the stock wheel shaft part 3*a* which projects from the side wall 8*b*. The rotation of the motor 82 which serves as a rotation driving means fixed to the inside of the side wall 8*b* is transmitted to the driving gear 33 via a motor pinion 83, transmission gear 84 and a pinion 84*a*.

Figure 6:
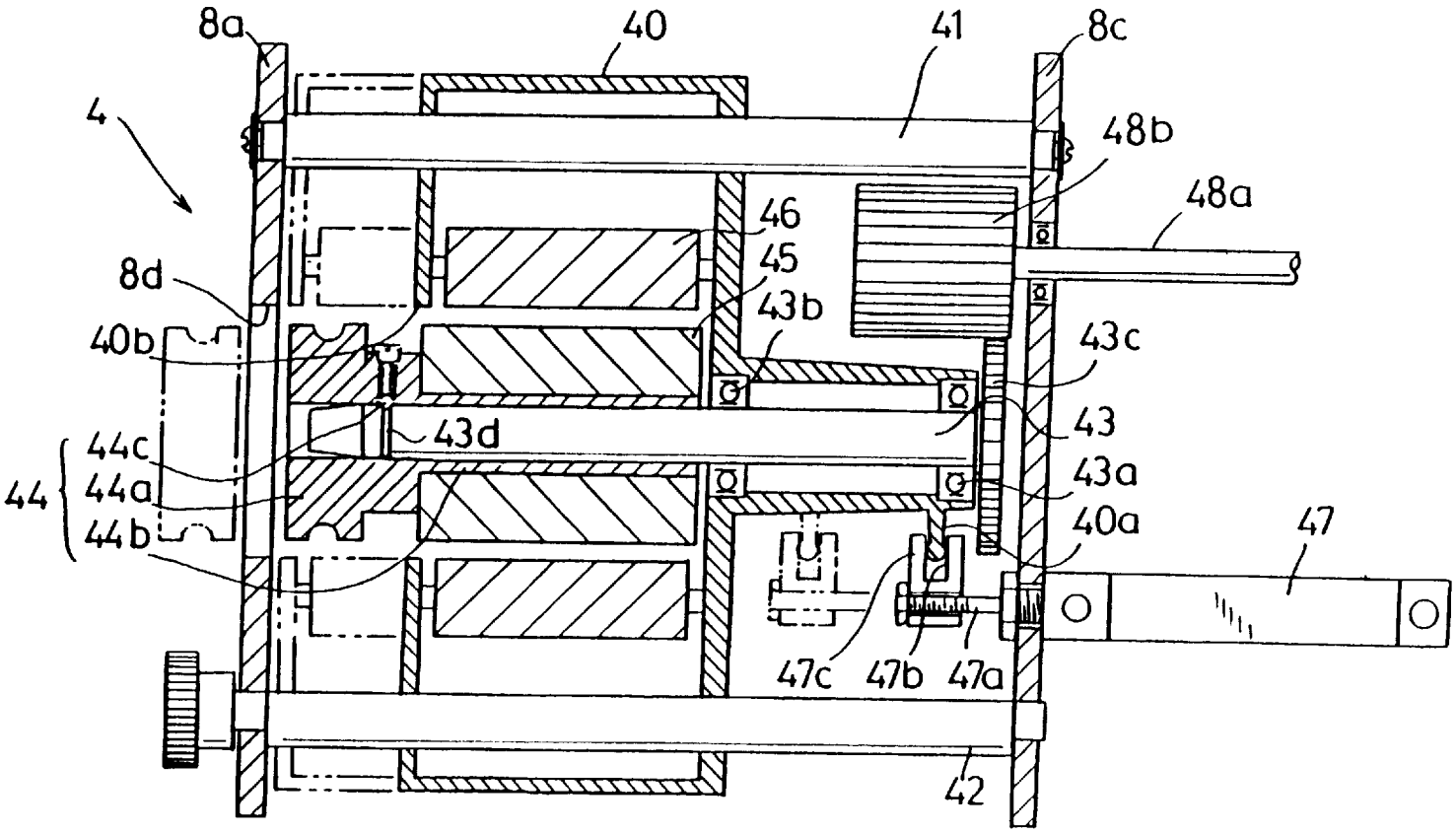
FIG. 6 is an expanded sectional view showing ink roller unit.

Between the side walls 8*a* and 8*b*, an intermediate wall 8*c* is provided so that an ink roller unit 4 is supported by the side wall 8*a* and the intermediate wall 8*c*. (See FIG. 1) In other words, as shown in FIG. 6, the unit frame 40 is slidably supported on the side wall 8*a* and the intermediate wall 8*c* via a support shaft 41. The posture of the unit frame 40 can be adjusted by rotating the eccentric shaft 42 rotatably supported on the side wall 8*a* and the intermediate wall 8*c*. Then the ink amount which is supplied to the printing type unit 5 on the printing type wheel 2 can be adjusted with the adjustment of the posture of the unit frame 40.

Approximately at the center of the unit frame 40, the central shaft 43 is fit, and the central shaft is rotatably supported on ball bearings 43*a* and 43*b*. One end (right end) of the central shaft 43 is projected from the unit frame 40, and a gear 43*c* is fixed to the projection end of the frame unit 40. In the other end (left end) of the central shaft 43, a cylinder body 44 is detachably attached. In this cylinder body 44, one end side forms a knob 44*a* and on the other end side, cylinder 44*b*, an ink roller 45 containing a thermally melting ink is fixed. The printing type unit 5 on the printing type wheel 2 contacts the external perimeter of the ink roller 45 so that the ink is deposited to and supplied to the printing type unit 5. As a structure in which the cylinder body 44 is detachably positioned with respect to the central shaft 43, a positioning member 44*c* is provided. A ball that can be moved forward or backward can be engaged with and removed from a ring groove 43*d* provided along the perimeter direction of the central shaft 43 with the result that the cylinder body 44 can be detachably attached and positioned.

To heat and melt the ink contained in the ink roller 45, an approximately ring-like heater 46 is fixed to the unit frame 40 so as to surround the ink roller 45. To move the unit frame 40 in the axial direction of the support shaft 41, a projecting piece 40*a* is provided on the unit frame. On a cylinder rod 47*a* of the cylinder 47 which serves as a movement driving means fixed to the intermediate wall 8*c*, a driving member 47*c* having a U-shaped groove 47*b* is fixed so that the projecting piece 40*a* is engaged with the U-shaped groove 47*b*.

In addition, to rotate and drive the ink roller 45 via the central shaft 43, a motor 48 (shown in FIG. 1) is fixed to the intermediate wall 8*c* with the result that a motor pinion 48*b* is fixed to a motor shaft 48*a* of the motor in such a manner that the motor pinion is engaged with the gear 43*c*.

On the side wall 8*a* and the unit frame 40, detachment ports 8*d* and 40*b* which have diameters larger than the diameter of the knob 44*a* and the ink roller 45 to enable the detachment and attachment of the ink roller 45.

Figure 7:
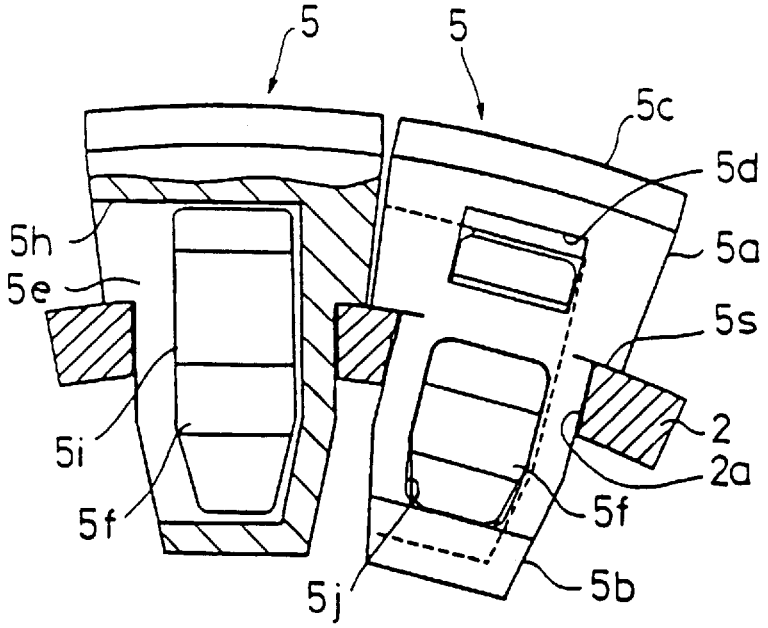
FIG. 7 is a partially notched expanded front view showing the ink roller unit.
Figure 8:
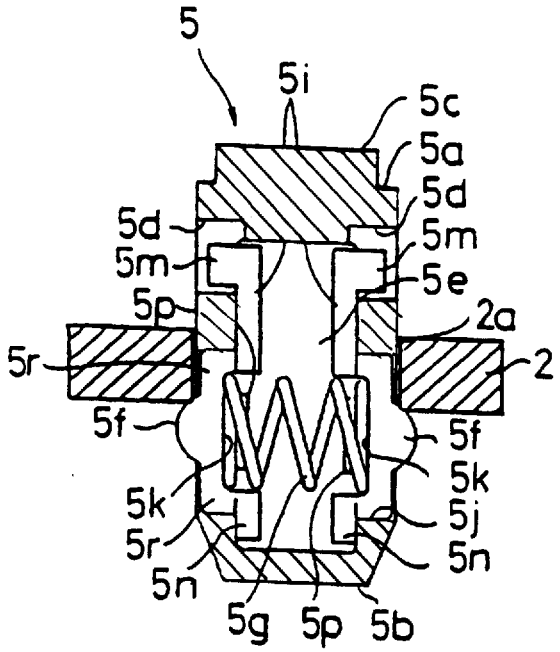
FIG. 8 is a sectional view showing the printing type unit of FIG. 7.

Subsequently, a structure of the printing type unit 5 will be explained. FIG. 7 is a view showing the printing type unit 52 for flow typing as one example from the front thereof. FIG. 8 is a view showing a section of the printing type unit 52 of FIG. 7, the unit being sectioned at the center. The printing type unit 51 for vertical typing has substantially the same structure. The typing direction in the attachment state of the typing unit to the printing type wheel 2 is rotated through 90 degrees. Then the structure of the printing type unit will be explained as a common printing type unit 5. The main body of the printing type unit 5 comprises a projecting part 5*a* exposed to the external perimeter from the printing type attachment part of the printing type wheel 2 or the stock wheel 3 and an insertion part 5*b* inserted into the printing type attachment part. The external sectional configuration of the insertion part 5*b* has an approximately square configuration. In the printing type attachment part, a square hole 2*a* slightly larger than the square hole of the insertion part 5*b* is provided. At the top of the projecting part 5*a*, a printing type surface 5*c* is provided for forming characters and symbols to be printed. On the side of the projecting part 5*a*, a gripping part 5*d* with which the grippers 60 and 60 of the robot 6 can be engaged are provided. (See FIG. 15)

Inside of the projecting part 5*a* and the insertion part 5*b*, a housing chamber 5*e* is provided for housing the holding means which will be described later and which allows engaging the printing type unit 5 in the printing type attachment parts 21 and 22 in the printing type wheel 2 or in the printing type attachment parts 31 and 32 of the stock wheel 3.

A structure of the holding means will be described in detail. The holding means comprises a pair of engagement parts 5*f* engaged in the printing type attachment part and a spring member 5*g* for energizing the pair of engagement parts in the engagement direction with the printing type attachment part. In other words, the housing chamber 5*e* is provided over the projecting part 5*a* and the insertion part 5*b*. On one surface (left side surface in FIG. 7) out of four surfaces constituting the housing chamber 5*e*, an opening 5*h* for assembling parts is formed. Inside of the housing chamber 5*e*, a pair of engagement pieces 5*i* and 5*i* is housed so as to face each other in a predetermined gap. In the intermediate part, an engagement projecting part 5*f* which constitutes the aforementioned engagement part is formed so as to be projected outward. To project the engagement projecting part to the outside, a window hole 5*j* is respectively formed in the housing chamber 5*e*. On the opposite surface of the intermediate part of the engagement projecting part 5*f*, a recessed part 5*k* is formed. Approximately at the center thereof, a cylindrical boss 5*p* is formed. With the bosses 5*p* and 5*p* and the recessed part 5*k* and 5*k*, a compressed coil spring 5*g* which serves as a spring member is stably accommodated. The height of the boss 5*p* is set so that the compression coil spring 5*g* is not disengaged and jumped out even when the pair of engagement pieces 5*i* and 5*i* is pushed and the length of the compression coil spring 5*g* becomes shorter than the width of the opening 5*h* and the compression coil spring 5*g* can be compressed and inserted at the time of assembling the printing type unit 5. The engagement pieces 5*i* and 5*i* are energized in a mutually repelling direction with the spring force of the compression coil spring 5*g* so that the engagement projecting part 5*f* is projected from the window hole 5*j*. Thus, the printing type unit 5 is engaged and held in the printing type attachment part. On the upper end of the engagement piece 5*i*, an operation projecting part 5*m* is provided at a position opposite to the gripping part 5*d*. When the operation projecting part is pressed with external force, the engagement piece 5*i* can be slid against the spring force of the compression coil spring 5*g*. On the lower end of the engagement piece 5*i*, a slide center part 5*n* is provided which constitutes a center at the time of sliding. In addition, an upper and a lower step part 5*r* of the engagement projecting part 5*f* is allowed to pass through the window hole 5*j*. As a consequence, the recessed part 5*k* is allowed to approach the engagement projecting part 5*f* so that, considering the upper limit of necessary spring force and stress, the thickness of the insertion part 5*b* of the printing type unit 5 can be minimized with respect to the compression coil spring 5*g* which is reduced in size as much as possible. Further, in accordance with the present embodiment, the thickness of the printing type unit 5 can be suppressed to 5 mm×5 mm with respect to the spring force 200*gf* of the compression coil spring 5*g*.

Figure 9:
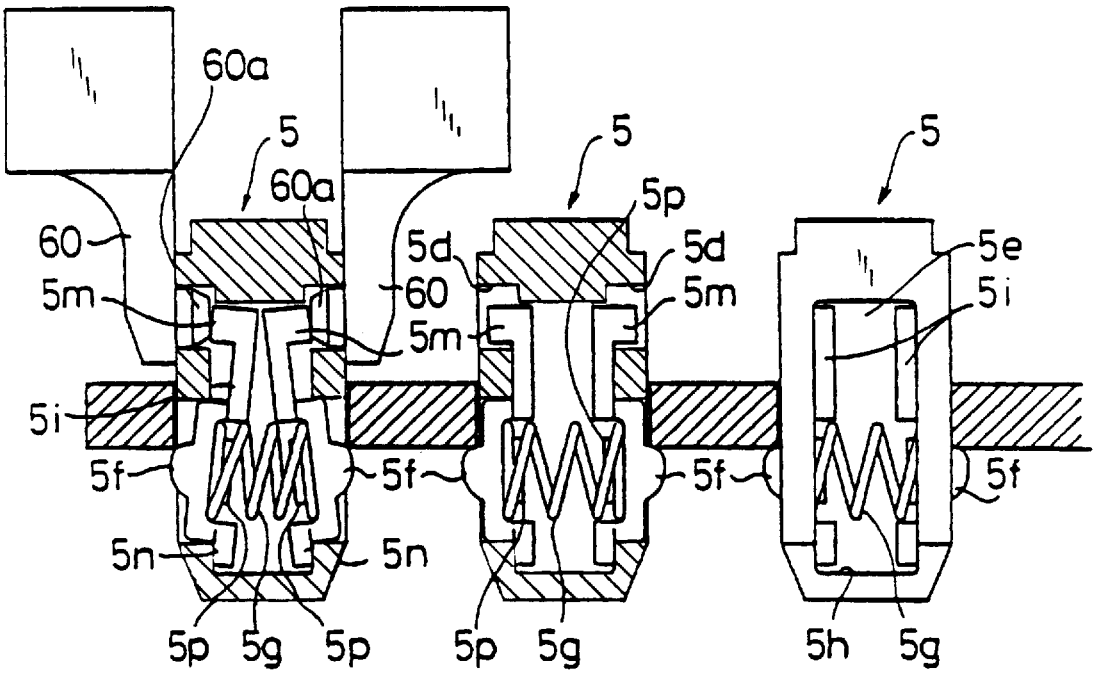
FIG. 9 is a sectional view and a side view for explaining a state in which the printing type unit of FIG. 7 is detached or attached to the printing type attachment part.

FIG. 9 shows a state in which the printing type unit 5 is detachably attached on the printing type attachment part. FIG. 9 shows a state in which the printing type unit in the left position oscillates on the oscillation central part 5*n*, and the engagement projecting part 5*f* is moved inward and therefore the printing type unit 5 is not engaged and held within the printing type attachment part when the operation projecting part 5*m* is pressed at the grippers 60 and 60 by the robot 6, to be described later, and the engagement piece 5*i* compresses the spring 5*g*. The height of the projection 60*a* of the grippers 60 and 60 to be described later has a size corresponding to the regression amount of the engagement projecting part 5*f*. The middle position in FIG. 9 shows a state in which the operation projecting part 5*m* is liberated from the grippers 60 and 60 of the robot 6. The engagement piece 5*i* is placed in a state of mutually repelling each other with the spring force of the compression coil spring 5*g* so that the engagement projecting part 5*f* is engaged in the printing type attachment part and therefore the printing type unit 5 is held. The printing type unit 5 at the right position shows a state in which the printing type unit is attached to the printing type attachment part. It can be seen that the engagement projecting part 5*f* is projected and engaged with the printing type attachment part. Incidentally, the positioning of the insertion part 5*b* in the insertion direction is performed with the stepped part 5*s* of FIG. 7. In addition, the top end of the insertion part 5*b* is tapered over the whole external perimeter to facilitate the insertion. The taper also serves to prevent the interference with the printing type unit 5 positioned in the vicinity. In addition, with the opening 5*h* which is formed on the left side the engagement pieces 5*i* and 5*i* and the compression coil spring 5*g* can be assembled into the housing chamber 5*e* by passing through the opening 5*h*. In other words, the thickness of the engagement piece 5*i* (from the inside surface to the top surface of the engagement projecting part 5*f*) is set to a size so that the second engagement piece 5*i* can be set in a state in which a first engagement piece 5*i* is set passing through the opening 5*h*. Incidentally, in a state in which the compression coil spring 5*g* is set, the engagement piece 5*i* will not be detached from the opening 5*h* even if one of the engagement pieces äi is pressed by the boss 5*p*. Consequently, a lid is not required in the opening 5*h*.

Figure 10:
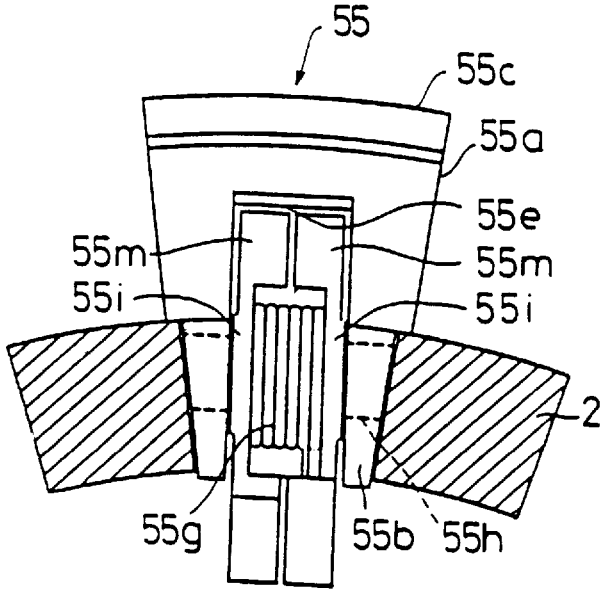
FIG. 10 is a partially notched expanded front view showing an example of an alternative structure of the printing type unit.
Figure 11:
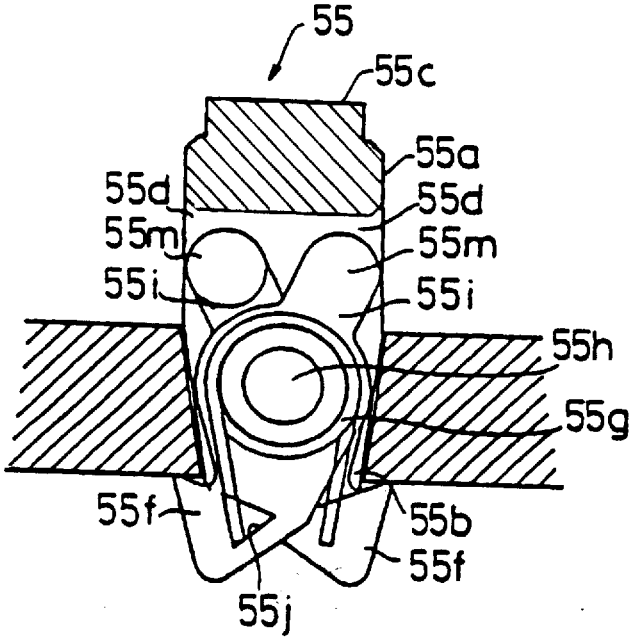
FIG. 11 is a sectional view showing the printing type unit of FIG. 10.
Figure 12:
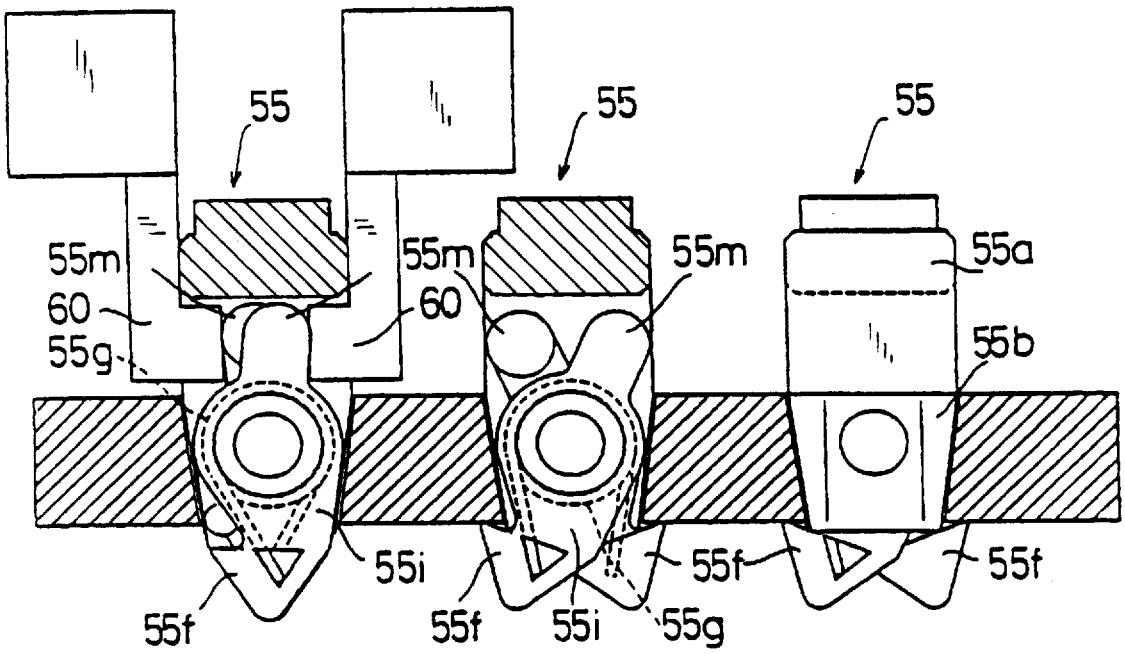
FIG. 12 is a sectional view and a side view for explaining a state in which the printing type unit of FIG. 10 is detached or attached to the printing type attachment part.

FIGS. 10 through 12 show examples of another structure of the printing type unit. The printing type unit 55 is the same as the printing type unit 5 described before in that the printing type unit 55 has a projecting part 55*a*, an insertion part 55*b*, and a printing type surface 55*c* on the top of the projecting part 55*a*, and a gripping part 55*d* is provided on the projecting part 55*a*. However, as shown in FIG. 10, the insertion part 55*b* has a length which is not projected into the inside of the printing type attachment part, and the projecting part 55*a* and the insertion part 55*b* are formed in approximately reverse U-shaped configuration. A gap formed by the reverse U-shaped configuration is the housing chamber 55*e*. A holding means is housed in the housing chamber.

In the holding means in this example, a pair of engagement pieces 55*i* and 55*i* are slidably supported with the central shaft 55*h* at the intermediate part while on the lower end part thereof, an engagement hook 55*f* with a triangular configuration which hook serves as the aforementioned engagement part is formed so as to be projected outward. On the upper end part of the engagement piece 55*i*, an operation projecting part 55*m* is provided and positioned in the gripping part 55*d*. On the central shaft 55*h* a twisted coil spring 55*g* which serves as a spring member is fit and supported. Both ends of the spring are hooked on the spring hook hole 55*j* which is provided on the engagement hook part 55*f*. The engagement pieces 55*i* and 55*i* receives the spring force of the twisted coil spring 55*g* to be energized so that the engagement hook parts 55*f* and 55*f* mutually repels each other to be engaged in the inside fringe of the printing type attachment part and the printing type unit 55 is engaged and held in the printing type attachment part. Then when the operation projecting part 55*m* is pressed with external force, the engagement piece 55*i* is oscillated against the spring force of the twisted coil spring 55*g* so that the engagement is detached with the engagement hook 55*f*. Further, the insertion part 55*b* and the printing type attachment part are formed in a tapered configuration so that the inside is narrowed down to facilitate the insertion of the engagement hook 55*f* and to secure the engagement state.

FIG. 12 shows a state in which this printing type unit 55 is detachably attached on the printing type attachment part. FIG. 12 shows the printing type unit at the left position in a state in which the operation projecting part 55*m* is pressed with the grippers 60 and 60 to be described later of the robot 6 with the result that the engagement piece 55*i* is oscillated against the spring force of the twisted coil spring 55*g*, the engagement hook 55*f* is moved backward and the printing type unit 55 is not engaged and held in the printing type attachment part. FIG. 12 shows the printing type unit 55 at the middle position in a state in which the operation projecting part 55*m* is liberated from the grippers 60 and 60 of the robot 6 to be described later. The engagement piece 55*i* is oscillated with the spring force of the twisted coil spring 55*g* so that the engagement hook 55*f* is engaged with the inside fringe of the printing type attachment part to engage and hold the printing type unit. FIG. 12 shows the printing type unit 55 at the right position in a state in which the printing type unit is attached on the printing type attachment part from the side position. It can be seen that the engagement hook 55*f* is projected to be firmly engaged in the inside fringe of the printing type attachment part. This is facilitated by the tapered configuration in which the inside is narrowed down.

Figure 13:
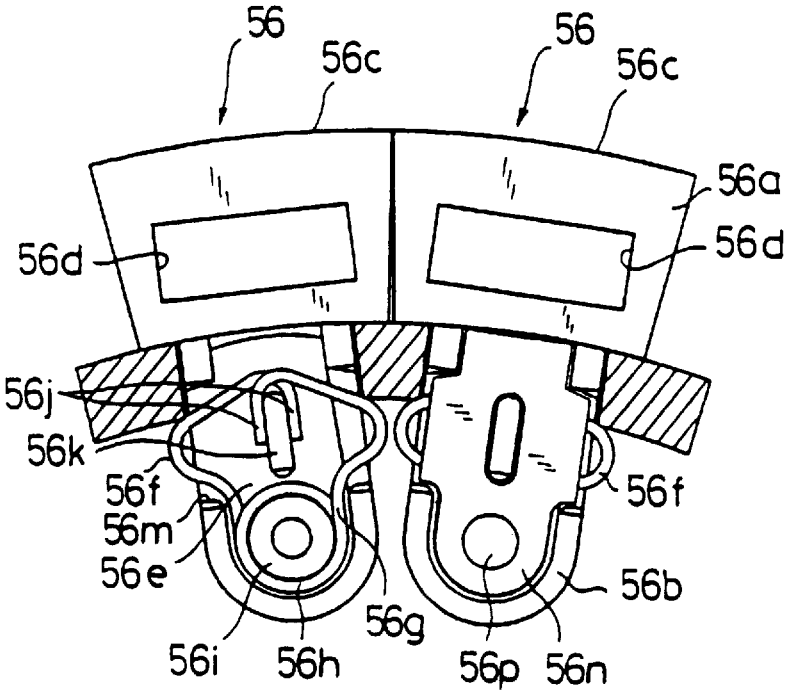
FIG. 13 is a partially notched expanded front view showing an example of still another alternative structure of the printing type unit.
Figure 14:
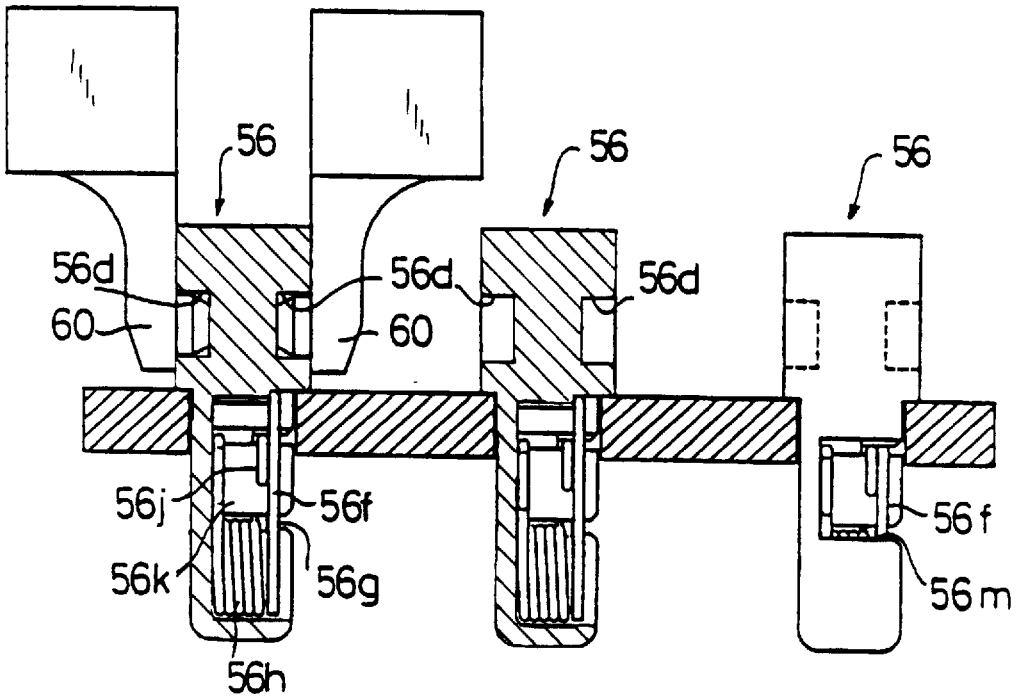
FIG. 14 is a sectional view and side view for explaining a state in which the printing type unit of FIG. 13 is detached or attached to the printing type attachment part.

FIGS. 13 and 14 show examples of still another structure of the printing type unit. The printing type unit 56 is the same as the aforementioned printing type units 5 and 55 in that the printing type unit 56 has a projecting part 56*a*, an insertion part 56*b*, a printing type surface 56*c* on the top surface of the projecting part 56*a*, and a gripping part 56*d* provided on the projecting part 56*a*. However, the holding means housed in the housing chamber 56*e* which is formed in the insertion part 56*b* utilizes the engagement projecting part 56*f* with the twisted coil spring 56*g* which serves as a spring member. In other words, a winding part 56*h* provided in the intermediate part of the twisted coil spring 56*g* is fit into the shaft part 56*i* which is projectingly provided on the lower end part of the housing chamber 56*e* to support the spring 56*g*. In the vicinity of both ends of spring, the engagement projecting parts 56*f* and 56*f* are constituted which are projected in a direction opposite to each other to be deflected. Both ends of the spring 56*g* are deflected and a regulating part 56*j* is provided for regulating the expansion angle of the spring. The regulating part 56*j* is engaged with the regulating piece 56*k* which is projectingly provided on the upper end part of the housing chamber 56*e* in an intersecting manner. Then in the housing chamber 56*e* a window hole 56*m* is formed which has a configuration such that the engagement projecting part 56*f* of the twisted coil spring 56*g* can be projected outward. The twisted coil spring 56*g* cannot be detached with screwing a spring press plate 56*n* to the shaft part 56*i* with a screw 56*p* after housed in the housing chamber 56*e*.

FIG. 14 shows a state in which the printing type unit 56 is detachably attached on the printing type attachment part.

FIG. 14 shows the printing type unit 56 at the left position in a state in which the grippers 60 and 60 to be described later are engaged in the gripping parts 56*d* and 56*d* of the printing type unit 56 to sandwich the printing type unit 56. When the printing type unit 56 is attached, the printing type unit is forcibly inserted into the printing type attachment part in this state. In the meantime, when the printing type unit 56 is detached, the printing type unit is forcibly pulled out from the printing type attachment part in this state. At this time, the engagement projecting part 56*f* of the coil spring 56*g* is relaxed relatively inward against the spring force and slides on the inside surface of the printing type attachment part to detach the printing type unit 56. After the attachment or the detachment, the engagement projecting part 56*f* is projected again with the spring force. At the time of the attachment, the engagement projecting part 56*f* is projected as shown in FIG. 13 so that the printing type unit 56 is engaged and held in the printing type attachment part. FIG. 14 shows the printing type unit at the position in a state in which the grippers 60 and 60 of the robot 6 to be described later are separated from the gripping part 56*d* and the printing type unit 56 is stably engaged and kept in the printing type attachment part. FIG. 14 shows the printing type unit at the right position as viewed from the side in a state in which the printing type unit is attached in the printing type attachment part. It can be seen that the engagement projecting part 56*f* is projected outward from the window hole 56*m* to be firmly engaged in the inside fringe part of the printing type attachment part.

Figure 15:
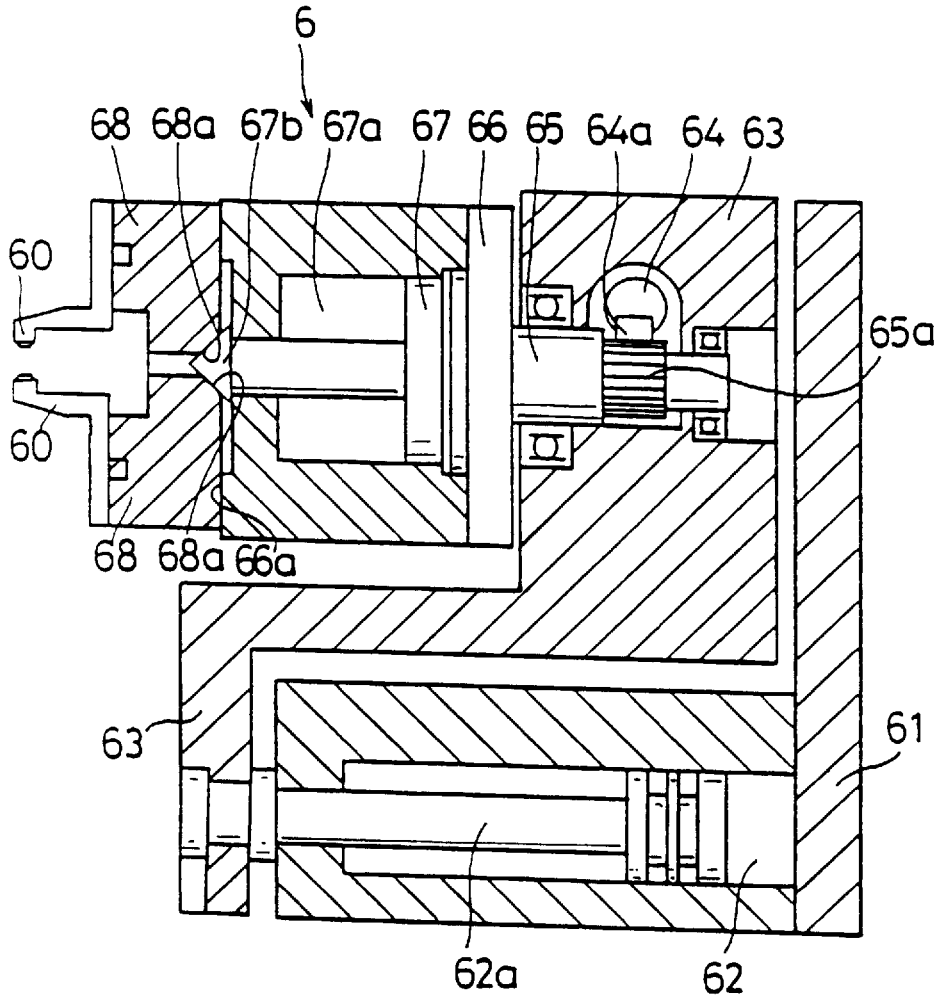
FIG. 15 is an expanded sectional view showing a robot.

As shown in FIG. 15, the robot 6 is provided with a pair of grippers 60 and 60 which sandwiches the printing type unit 5. The robot 6 is provided with means for moving forward and backward the pair of grippers in the radial direction with respect to the printing type wheel 2 or the stock wheel 3 and means for rotating the grippers through 90 degrees.

At the outset, a first cylinder 62 is fixed to first attachment plate 61 and a second attachment late 63 is fixed to a cylinder rod 62*a* of the first cylinder 62. Driving the first cylinder 62 moves the second attachment plate 63 forward and backward and moves the gripper 60 in the radial direction with respect to the printing type wheel 2 or the stock wheel 3.

A second cylinder 64 is fixed on the second attachment plate 63. Then a rack 64*a* is provided which can be driven to be moved back and forth with the second cylinder. On the second attachment plate 63, a rotation shaft 65 is rotatably provided, and a pinion 65*a* which is engaged with the rack 64*a* is provided on the rotation shaft. A third attachment plate 66 is provided on the projection end of the rotation shaft 65 which is projected from the second attachment plate 63. Driving the second cylinder 64 moves the rack 64*a* back and forth and rotates the pinion 65*a* with the result that the third attachment plate 66 is rotated via a rotation shaft 65 and rotates the grippers 60 and 60 thereby changing the opposite direction of both grippers through 90 degrees.

On the third attachment plate 66, a third cylinder 67 is fixed and a cum member 67*b* with a triangular cross section is provided at the end of the cylinder rod 67*a*. The pair of grippers 60 and 60 are fixed to the front end of a pair of gripper attachment members 68 and 68. The pair of gripper attachment members 68 and 68 is slidably provided on the front end 66*a* of the third attachment plate 66. Inclined cum surfaces 68*a* and 68*a* which face and contact with the inclined surface of triangular cross section of the cum member 67*b* are formed on the rear end port of the surface opposite to the gripper attachment member. Consequently, driving the third cylinder 67 moves the cum member 67*b* back and forth so that the gripper attachment members 68 and 68 are pressed against the inclined surface of the cum member and slides along the front end surface 66*a* of the third attachment plate 66 in the opposite direction to each other so as to either separate therefrom or to come close thereto. Thus, opening and closing the grippers 60 and 60, and thereby enabling sandwiching the printing type unit 5.

Further, as means for moving the robot 6 in parallel with respect to the printing type wheel 2 and the stock wheel 3, as shown in FIG. 1, a lead screw 69 rotatably supported on the side walls 8*a* and 8*a* is allowed to penetrate and engage the robot 6, and a motor 69*a* which rotatably drives the lead screw is fixed to the side walls 8*a*. In addition, the robot 6 is constituted so as to be guided to move by the guide rod 69*b* fixed to the side walls 8*a* and 8*b* in parallel with the lead screw 69. Thus, the posture of the robot 6 is correctly maintained.

Figure 16:
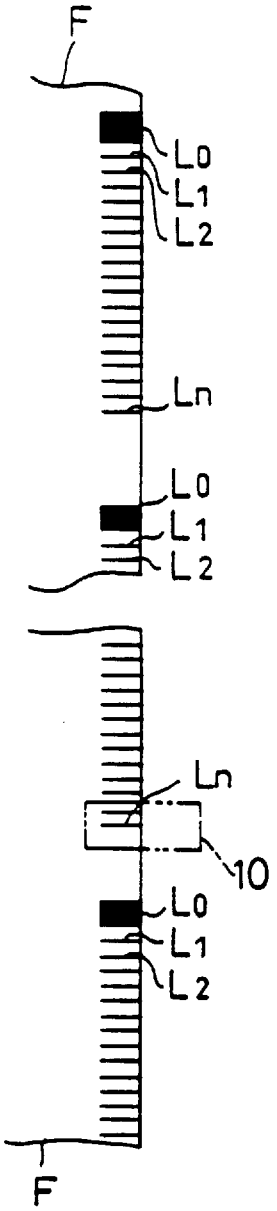
FIG. 16 is a partial front view for explaining marks on the fringe of a package.

As shown in FIGS. 1 and 16, on the fringe of the package F to be printed, a mark indicative of the cutting reference position which constitutes a reference for cutting the package F with a packing machine after packaging products, namely a so-called register mark L0 is printed and formed at a predetermined interval. At the same time, between the register mark L0 and the following register mark, a plurality of marks L1 through bn are printed and formed at a predetermined interval. The printing type printer is provided with a sensor 10 for detecting register mark L0 and marks L1 through Ln. The width of the register mark L0 is formed in a thickness thicker than the width of each of marks L1 through Ln. The sensor 10 is constituted to detect the register mark L0 and each of the marks L1 through Ln with a difference in width.

The marks L1 through Ln corresponds to the rotation angle of the printing type wheel 2. The register mark L0 is set so that the position detected by the sensor 10 constitutes a home position of the printing type wheel 2. Then when the sensor 10 detects the register mark L0 along with the conveyance of the package F, the motor 82 is excited to be set in a driving wait state. After that, every time the sensor 10 detects the marks L1 through Ln one by one, the motor 82 is rotated and driven through a predetermined angle. While the sensor 10 detects the marks L1 through Thn with the driving of the motor 82, the printing type wheel 2 rotates one time at a rotation speed identical to the conveyance speed in synchronization with the conveyance of the package F. After that, the driving of the motor 82 is suspended. In other words, the rotation of the printing type wheel 2 is suspended at a position in which the printing type wheel 2 is brought back to the home position. When the sensor 10 detects the following register mark L0, the motor 82 is exited again to be set in a driving wait state. After that, the sensor 10 detects the mark L1, and the driving of the motor is started with the detection. When the printing type wheel begins to be rotated, the printing type wheel 2 is constituted to be rotated from the home position. In this case, when ever the sensor 10 subsequently detects the marks L1 through Ln, the motor 82 is rotated and driven through a predetermined angle. When the sensor 10 detects the marks L1 through Ln with the driving of the motor 82, the printing type wheel 2 is rotated one time at the rotation speed identical to the conveyance speed of the package F in synchronization with the conveyance of the package F so that the printing position can be determined corresponding to the position of the marks L1 through Ln and can be changed to an arbitrary position by changing the gap between the register mark L0 and the mark L1.

Incidentally, the marks L1 through Ln may be provided to equally dividing the whole gap between the marks and the adjacent register mark L0. In such a case, it is required that the rotation driving angle of the motor 82 or the diameter of the printing type wheel 2 at the time when the sensor 10 detects the marks L1 through Ln is set so that the printing type wheel 2 rotates just one time while the sensor 10 detects the marks L1 through Ln.

The motor 48 which rotates and drives the ink roller 45 is constituted to be rotated and driven in synchronization with the motor 82. In other words, when the sensor 10 detects the register mark L0, the motor is excited to be set in a driving wait state. After that, every time the sensor 10 subsequently detects the marks L1 through Ln, the motor 48 is rotated and driven through a predetermined angle. When the sensor 10 detects the marks L1 through Ln with the driving of the motor 48, the ink roller 45 rotates at the same rotation speed with the printing type wheel 2 in synchronization with the rotation of the printing type wheel 2 followed by suspending the driving of the motor 48 and controlling the driving of the motor 48 so that the rotation of the motor 48 is suspended along with the suspension of the rotation of the printing type wheel 2.

Further, the cylinder 47 which moves the ink roller 45 in the axial direction is driven by the change of air pressure at a predetermined timing in synchronization with the motor 82 and the motor 48. The cylinder 47 is set so that the cylinder rod 47*a* is moved back after moved forward and brought back to the original position at the time of the suspension of the motors 82 and 48. Next, an operation of the printing type printer will be explained.

When the date of manufacture or the like is printed on a package F, power is supplied in advance to the heater 30 and the heater 46 to warm the printing type wheel 2 and the stock wheel 3. At the same time, the ink roller 45 is warmed to melt the ink. Then printing type units 5, 55 or 56 (an example in which the printing type unit 5 will be explained hereinafter) suitable for desired printing form such as the printing type unit 51 for vertical typing or the printing type unit 52 for flow typing are detached from the printing type attachment parts 31 and 32 of the stock wheel 3 and are selectively attached on a first printing type attachment part 21 or a second printing type attachment part 22 of the printing type wheel 2. Incidentally, in the case where the printing type unit 52 is attached on the printing type wheel 2, the date of manufacture or the like can be printed on the package F by setting the conveyance direction as the right and left direction. In the case where the printing type unit 51 is attached on the printing type wheel 2, the date of manufacture or the like can be printed on the package F by setting the direction vertical to the conveyance direction as the right and left direction.

In the case where the printing type unit 5 is detached from the stock wheel 3 to be attached on the printing type wheel 2, the motor 69*a* is driven to rotate the lead screw 69 and to move the robot 6 to a position opposite to the stock wheel 3. Then the motor 82 is driven to rotate the stock wheel to place the desired printing type unit 5 stocked in the stock wheel 3 to be opposite to the robot 6. After the desired printing type unit 5 is placed opposite to the robot 6, the cylinder 64 is driven to change the opposite direction of the grippers 60 and 60 as to agree with the gripping parts 5*d* and 5*d* of the printing type unit 5. After that, the cylinder 67 is driven to move the cylinder rod 67*a* forward to mutually separate the grippers 60 and 60 via the cum member 67*b* followed by driving the cylinder 62 to move the grippers forward to place the grippers opposite to the gripping parts 5*d* and 5*d*. After the grippers 60 and 60 are placed to be opposite to the gripping parts 5*d* and 5*d*, the cylinder 67 is driven to move the cylinder rod 67*a* backward so that the grippers mutually come close to each other and are inserted into the gripping parts 5*d* and 5*d* of the printing type unit 5 to press the operation projecting part 5*m*. Consequently, engagement piece 5*i* oscillates centering on the central part 5*n* of oscillation against the spring force of the compression coil spring 5*g* and the engagement projecting part 5*f* is moved backward with the result that the printing type unit 5 is not engaged and held in the printing type attachment part of the stock wheel 3. Then the cylinder 62 is driven to move back the cylinder rod 62*a*, and remove the insertion part 5*b* of the printing type unit 5 from the printing type attachment part of the stock wheel, the printing type unit 5 can be easily taken out.

After the printing type unit is detached from the printing type attachment part of the stock wheel 3, the motor 69*a* is driven again to rotate the lead screw 69 and move the robot 6 to a position opposite to the printing type wheel 2. After the robot is moved to a position opposite to the printing type wheel 2, the motor 82 is driven to rotate the printing type wheel so that the printing type attachment part to be attached with the printing type unit 5 is placed opposite to the printing type unit sandwiched in the robot 6. After that, the cylinder 62 is driven to move the cylinder rod 62*a* forward to insert the insertion part 5*b* of the printing type unit 5 into the printing type attachment part of the printing type wheel 2. At the time of insertion, the operation projecting part 5*m* still remains pressed with the grippers, and the engagement projecting part 5*f* is also moved back so that the insertion part 5*b* can be inserted into the printing type attachment part with a slight pressure.

After the printing type unit 5 is inserted into a square hole 2*a* of the printing type attachment part of the printing type wheel 2, the cylinder 67 is driven to move the cylinder rod 67*a* forward so that the grippers 60 and 60 are mutually separated from each other via the cum member 67*b*. Consequently, the operation projecting part Sm is liberated from the pressure of the grippers with the result that the engagement piece äi is placed in a state of mutually repelling state with the spring force of the spring 5*g*. Since the engagement projecting part 5*f* is engaged with the printing type attachment part, the printing type unit 5 is stably engaged and held in the attachment position with the step part 5*s*. Incidentally, the printing type unit is positioned with a square hole 2*a* in a direction parallel to the printing type surface.

After the printing type unit 5 is attached in the printing type wheel 2 in this manner, the printing type wheel is brought back to the home position state by driving the motor 82.

Then at the time of printing, the package F is conveyed. Then when the sensor 10 detects the register mark L0 along with the conveyance of the package F, the motor 82 is excited to be placed in a driving wait state. After that, every time the sensor 10 subsequently detects the marks L1 to Ln, the motor 82 is rotated and driven through a predetermined angle. At the same time, the motor 48 is rotated and driven in synchronization with the motor 82. Further, the cylinder 47 is driven at a predetermined timing in synchronization with the motor 82 and the motor 48. Driving the motor 48, the motor 82 and the cylinder 47 at this time causes the printing type wheel 2 to rotate once in synchronization with the conveyance of the package F at the rotation speed identical to the conveyance speed of the package F while the sensor 10 detects the marks L1 to Ln. At the same time, the ink roller 45 moves at a predetermined timing in the axial direction while rotating in synchronization with the rotation of the printing type wheel 2 at a rotation speed identical to that of the printing type wheel 2. The rotation of the printing type wheel 2 at this time causes the printing type surface 5*c* of the printing type unit 5 to contact the ink roller 45 so that ink is deposited onto the printing type surface 5*c*. After that, when the printing type surface 5*c* contacts the package F at a position opposite to the platen 7, the ink is deposited on the package F for printing. In this printing operation, the rotation and the movement of the ink roller in the axial direction changes the contact position of the ink roller 45 and the printing type unit 5. With this change of the contact position, the ink contained in the ink roller is uniformly consumed to be uniformly deposited on the printing type surface at all times thereby preventing the generation of non-uniformity of the ink at the time of printing.

After the sensor 10 detects the Ln and the printing type wheel 2 is rotated once, the driving of the motor 48, the motor 82 and the cylinder 47 is suspended and the printing type wheel 2 is suspended after being brought back to the home position. At the same time, the rotation of the ink roller 45 and the movement of the ink roller 45 in the axial direction are suspended. After that, along with the conveyance of the package F, when the sensor 10 detects the register mark L0, the motor 82 is excited again to be placed in a driving wait state. After that the following printing is performed in the same manner as described above.

The product is packaged in the package F printed in this manner with the packaging machine not shown so that a process of cutting the package at the register mark L0 is successively performed with the cutting machine.

When finally the ink contained in the ink roller 45 becomes scarce so that the ink roller is required to be changed, the cylinder 47 is driven to move the cylinder rod 47*a* forward as shown by the dash lines in FIG. 6. Since the unit frame 40 is moved in the axial direction via a driving member 47*c* and a projection piece 40*a* and the knob 44*a* is projected from the detachment port of the side wall 8*a*, if the knob 44*a* is picked and pulled out, the knob is detached from the central shaft 43 with the positioning member 44*c* so that the ink roller 45 can be detached. Then when the new ink roller is fit into the central shaft 43, the ink roller can be held in position with the positioning member 44*c*. Thus the ink roller does not easily come off.

Incidentally, in accordance with the aforementioned embodiment, the printing type wheel 2 and the stock wheel 3 are coaxially arranged in a row. However, the embodiment is not limited thereto. The printing type wheel and the stock wheel need not be arranged in a row. They may be just coaxially arranged. In this case, since the movement direction of the robot 6 is parallel with respect to the axial direction, the driving of the robot 6 is still simple and efficient.

In addition, in the aforementioned embodiment, the driving of the cylinder 47 which moves the ink roller 45 in the axial direction is synchronized with the motor 82 which rotates the printing type wheel. However, the embodiment is not limited thereto. For example, the printing type printer may be constituted so that a driving signal is supplied at a predetermined timing to the cylinder 47 at the time of printing to move the ink roller 45 at a predetermined timing in the axial direction at a predetermined distance.

In addition, in the aforementioned embodiment, the ink roller 45 is rotated and driven at the time of printing. However, the motor 48 may be omitted such that the ink roller 45 would then rotate due to contact with the printing type wheel 2 which contacts the printing type unit.

In addition, in the aforementioned embodiment, an explanation was given in which a pair of engagement parts is provided on the main body of the printing type unit 5. Regardless of the number, the engagement part has only to be engaged on the printing type attachment part of the printing type wheel 2. The printing type unit may be constituted so that a single engagement part or two or more engagement parts are provided on the main body of the printing type unit 5.

Next, other structures of the printing type wheel and the stock wheel will be explained on the basis of FIG. 17.

Figure 17:
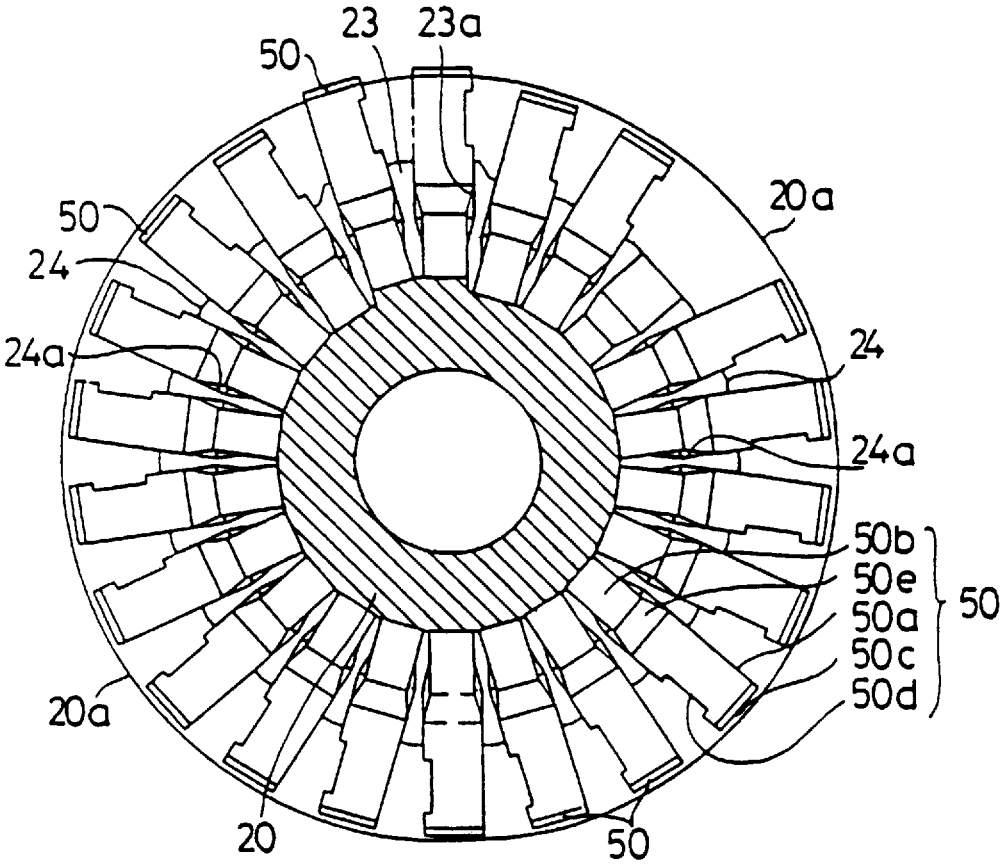
FIG. 17 is an expanded sectional view for explaining an example of an alternative structure of the wheel.

In this example, a printing type wheel part 23 and a stock wheel part 24 are provided by sectioning the peripheral surface of the single wheel body 20 in the axial direction as shown in FIG. 17. On the printing type wheel part 23 and the stock wheel part 24, the attachment parts of the printing type unit 50, 23*a* and 24*a*, which is open to a peripheral surface and has a predetermined depth are radially provided. Multiple rows of printing type attachment parts are provided by sectioning the printing type attachment parts 23*a* and 24*a* with a fringe part 20*a* having a diameter larger than the peripheral surface of the wheel body 20 and smaller than the printing surface. Although not shown, in the case where the printing type unit for the vertical typing and the printing type unit for flow typing are prepared, providing two kinds of printing type attachment parts is the same as the aforementioned case.

The shape of the printing type attachment parts 23*a* and 24*a* corresponds to the shape of the printing type unit 50 to be described later. (See FIG. 17) The width of the opening of the hole on the central side is small, and the width of the opening on the peripheral side is larger than this. The shape of the printing type unit 50 comprises a projecting part 50*a*, an insertion part 50*b*, and an inclined part 50*e* connecting the projecting part 50*a* and the insertion part 50*b*. The width of the projecting part 50*a* has a size sufficient to be frictionally inserted into the opening width of the hole on the peripheral side. Since the width of the insertion part 50*b* has a size sufficient to be inserted into the opening width of the hole on the central side, the width is smaller than the width of the projection part 50*a*. Therefore, in the case where the printing type unit 50 is attached on the printing type attachment parts 23*a* and 24*a*, the printing type unit 50 is frictionally attached on the central side of the printing type attachment part at the top of the insertion part 50*b*, and is frictionally attached on the peripheral side of the printing type attachment part at the projection part in the vicinity of the inclined part 50*e*. Therefore, it is difficult for the printing type unit to come off.

The top of the projection part 50*a* is a surface 50*c* on which characters and symbols to be printed are formed. On the side of the projection part 50*a*, a recessed part 50*d* is provided in which the grippers of the robot can be engaged.

The operation of printing in the case where such a wheel body 20 is used is substantially the same as the operation which has been described before. The printing type unit 50 is detached from the printing type attachment part 24*a* by moving the robot in the axial direction and rotating the wheel body 20 to allow the desired printing type unit 50 of the stock wheel part 24 and the robot to be located opposite to each other and by sandwiching the printing type unit with the grippers. Then the detached printing type unit 50 is attached on the predetermined printing type attachment part 23*a* of the printing type wheel part 23 by rotating the wheel body 20 again. The surface 50*c* of the printing type unit which is attached on the printing type wheel part is projected from the surface 50*c* of the printing type unit which is stocked. The ink is deposited only onto the surface 50*c* of the printing type unit in which the printing type wheel part 23 is attached with the result that the desired printing is performed.

An example of another structure of the ink roller unit 4 will be explained by referring to FIGS. 18 through 22.

Figure 18:
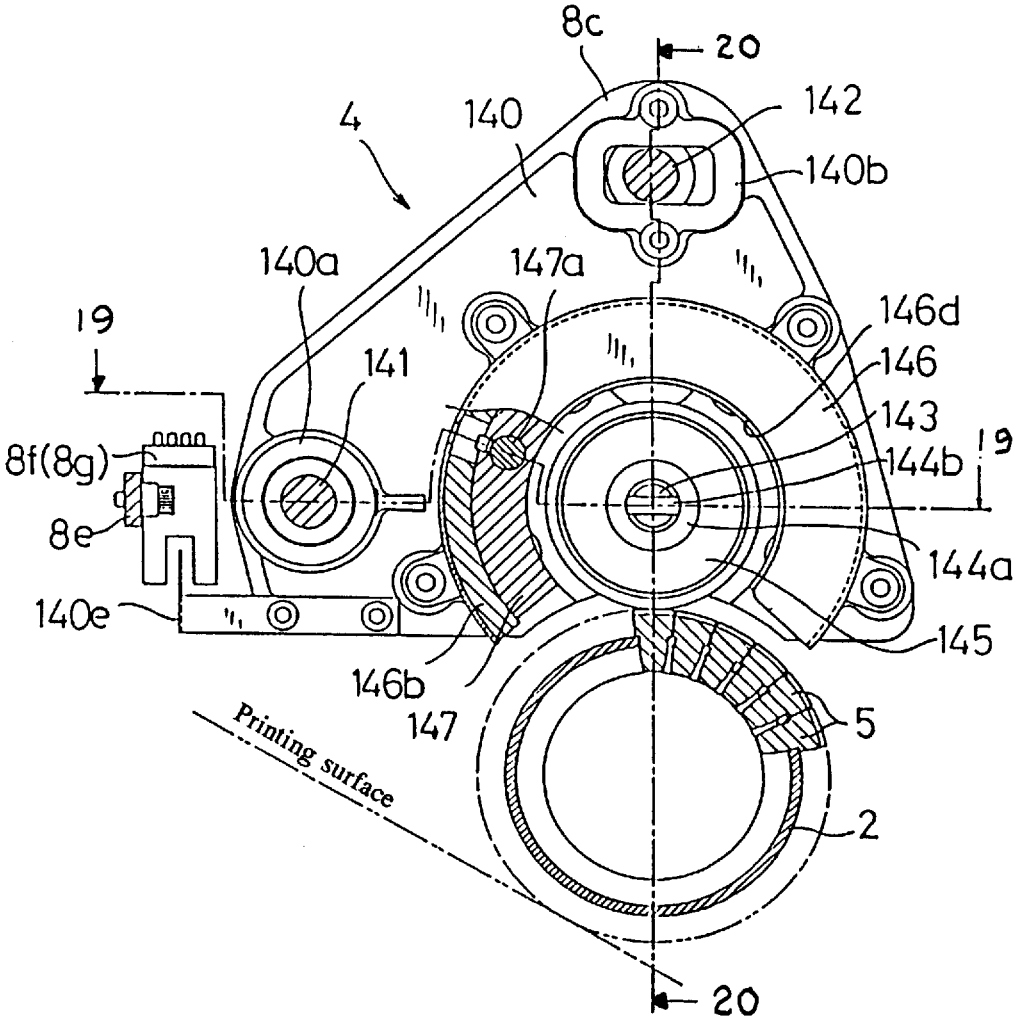
FIG. 18 is an expanded sectional view showing an example of an alternative structure of the ink roller unit.
Figure 19:
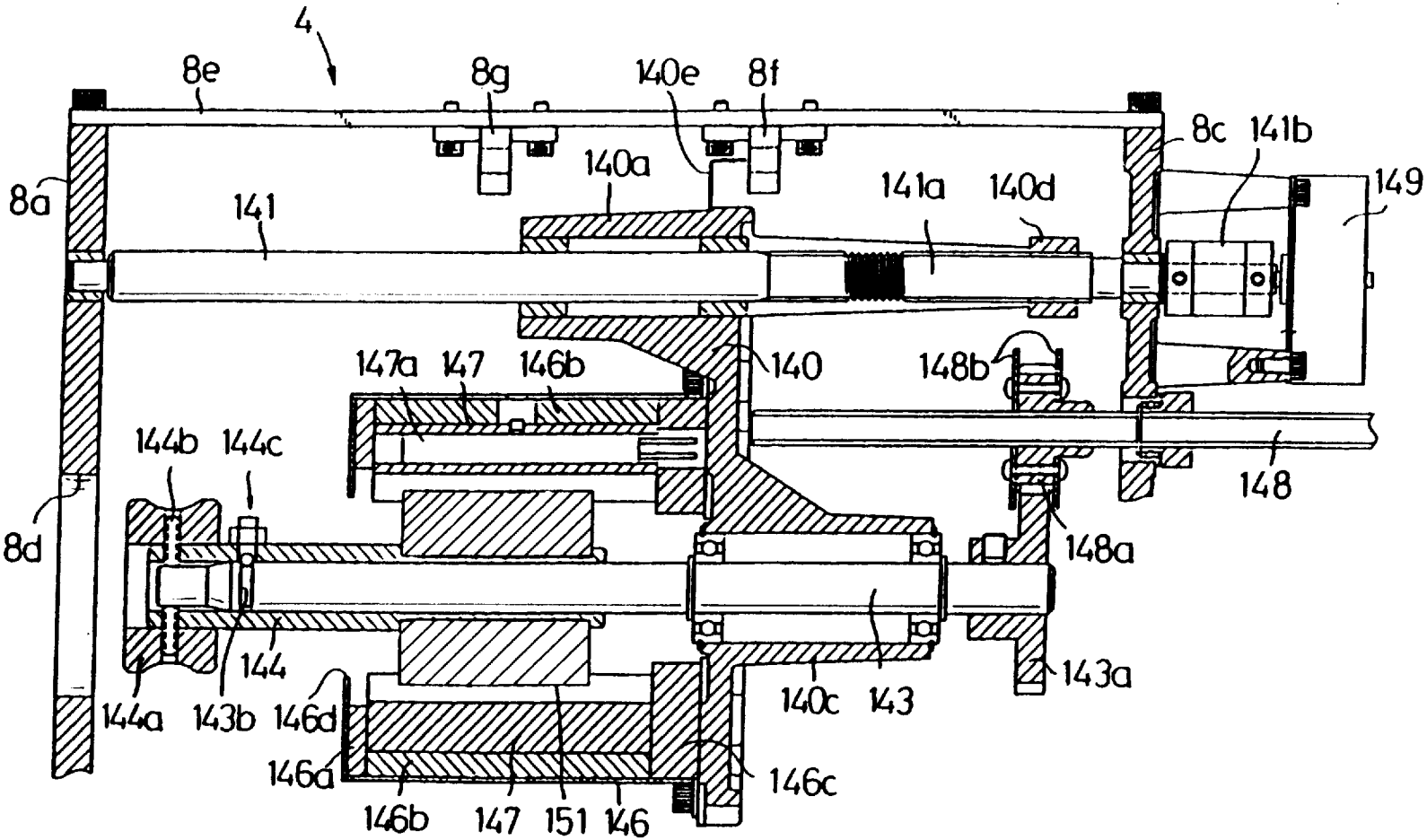
FIG. 19 is a sectional view taken along line A—A of FIG. 18.
Figure 20:
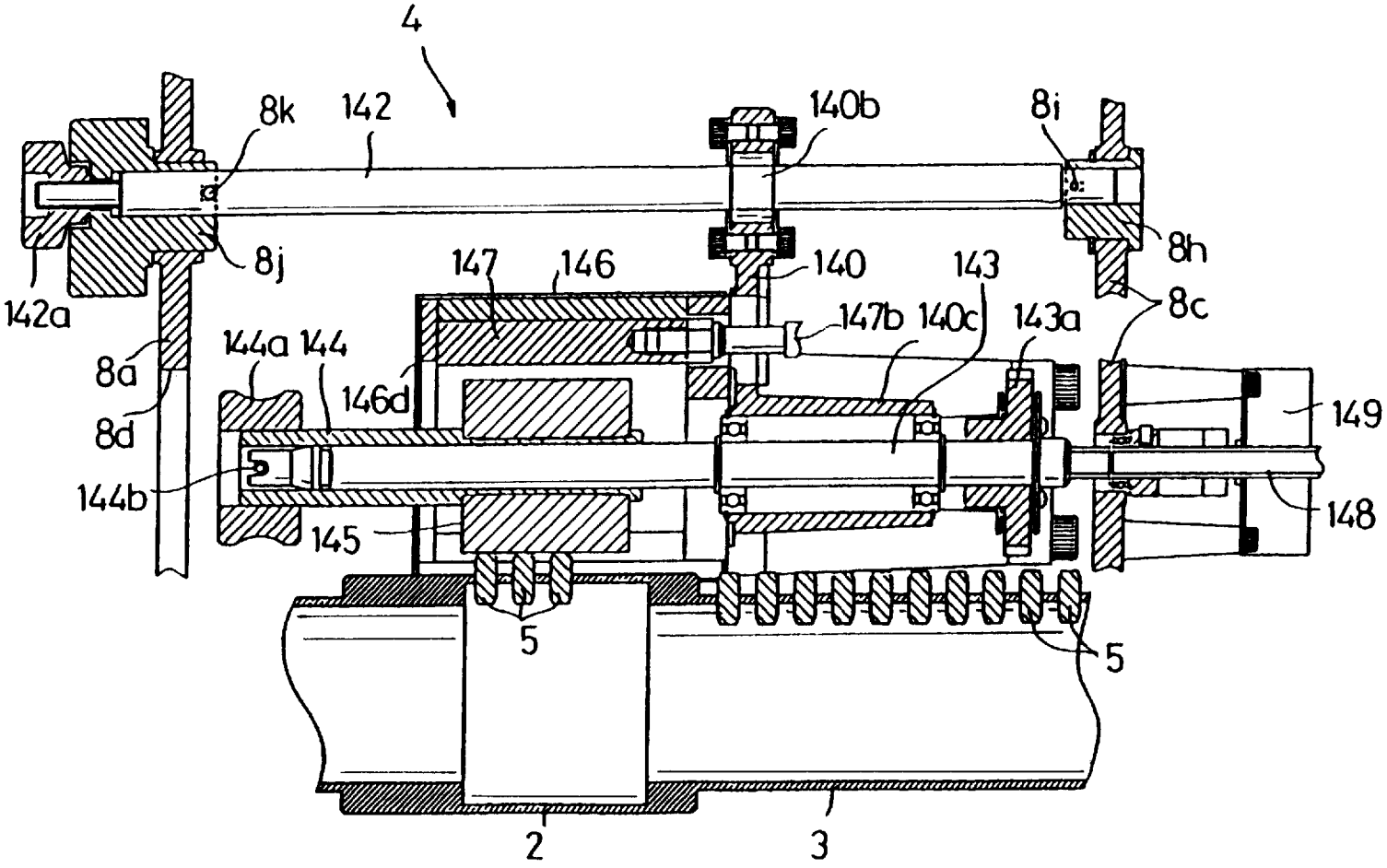
FIG. 20 is a sectional view taken along line B—R of FIG. 18.

In this example, as shown in FIGS. 18 through 20, a base 140 is movably supported on the printing type wheel 2 in the axial direction with a first guide shaft 141 rotatably supported on the side wall 8*a* and an intermediate wall 8*c* and a second guide shaft 142. In other words, a cylinder part 140*a* which is provided on the base 140 is slidably fit into the first guide shaft 141. The guide member 140*b* provided on the base 140 is slidably fit into the second guide shaft 142. On the base 140, a central cylinder part 140*c* projecting to the opposite direction is provided at a predetermined interval from the cylinder part 140*a*. A central shaft 143 is rotatably supported on the central cylinder part 140*c*. One end (right end) of the central shaft 143 is projected from the central cylinder part 140*c*, and a gear 143*a* is fixed to the projection end.

As a structure for rotating and driving the central shaft 143, a driving shaft 148 is rotatably provided by penetrating the intermediate wall 8*c*. The rotation of the motor 82 for rotating and driving the printing type wheel 2 is transmitted to the driving shaft 148. In other words, a transmission gear 148*a* is provided at a part projecting inward from the intermediate wall 8*c* of the driving shaft 148. To the transmission gear 148*a*, the rotation force is transmitted from the driving shaft 148. The structure allows the transmission gear 148*a* to slide to the axial direction of the driving shaft 148. The transmission gear 148*a* is engaged with the gear 143*a* of the central shaft 143 to transmit the rotational force. On both sides of the transmission gear 148*a*, side plates 148*b* and 148*b* with a diameter larger than that of the transmission gear are fixed so that the engagement of the transmission gear 148*a* and the gear 143*a* is not detached.

To the other end (left end) of the central shaft 143, a cylinder body 144 is detachably fit. On one end of the cylinder body 144, a knob 144*a* is fixed. The cylinder body 144 and the central shaft 143 are constituted to be integrally rotated with a pin 144*b*. The pin 144*b* is free with respect to the axial direction of the central shaft 143. On the other end of the cylinder body 144, an ink roller 145 which contains thermally melting ink is fixed. The printing type unit 5 on the printing type wheel 2 contacts the external periphery of the ink roller 145 so that ink is deposited and supplied to the printing type unit 5. As a structure for detachably attaching the cylinder body 144 with respect to the central shaft 143, the positioning member 144*c* is provided. A ball which can be moved back and forth with a spring can be detachably engaged in a ring groove 143*b* which is provided along the peripheral direction of the central shaft 143 so that the cylinder body 144 can be attached or detached and positioned.

A cover 146 having a predetermined space inside is fixed to the base 140 by surrounding the ink roller 145. In the cover 146, a heater block 147 for heating and melting the ink is provided via heat insulating materials 146*a*, 146*b* and 146*c*. The heater block 147 is constituted by arranging a plurality of heaters 147*a* in an equal interval on a concentric circumference of the ink roller 145. The heat of the heater is transmitted to the whole heater block 147 to uniformly heat the whole ink roller 145. To control the heater 147*a* by detecting the temperature of the heater block 147, a thermistor 147*b* is connected to the heater block 147.

Next, an explanation will be given with respect to the separation driving means for separating the ink roller 145 from the printing type unit 5. In the beginning, as separation means for separating the ink roller 145 in the axial direction of the printing type wheel 2, as shown in FIG. 19, a feed screw part 141*a* is provided in the middle on the side of the intermediate wall 8*c* of the first guide shaft 141. Further, at a separate position toward the intermediate wall 8*c a* in the axial direction from the cylinder part 140*a*, a female screw 140*d* is provided and fixed to the base 140. This female screw is engaged with the feed screw part 141*a*. A projection end from the intermediate wall 8*c* of the first guide shaft 141 is connected to the driving shaft of the motor 149 via joint 141*b*. Consequently, the rotation of the first guide shaft 141 by the motor 149 is converted to the movement of the printing type wheel 2 of the base 140 in the axial direction by the female screw 140*d* and the feed screw 141*a*.

As shown in FIG. 19, a support plate 8*e* is fixed to the sidewall 8*a* and the intermediate wall 8*c* in parallel with the first guide shaft 141. The sensor 8*f* and the sensor 8*g* are fixed with a predetermined gap to constitute so that the detection piece 140*e* projectingly provided on the base 140 can be detected with both sensors. The position in which the detection piece 140*e* can be detected with the sensor 8*f* constitutes the home position of the ink roller 145. The position in which the detection piece can be detected with the sensor 8*g* constitutes the exchange position of the printing type unit 5 and the ink roller 145.

Next, an explanation will be given with respect to means for separating the ink roller 145 in the radial direction of the printing type wheel 2. This means also functions to adjust the amount of ink which is supplied to the printing type unit 5 on the printing type wheel 2. In other words, as shown in FIG. 18 and FIG. 20, one end of the second guide shaft 142 is connected to the eccentric bearing 8*h* rotatably supported on the intermediate wall 8*c* with a pin 8*i*. The other end of the second guide shaft 142 is connected to the eccentric knob 8*j* rotatably supported on the side wall 8*a* with a pin 8*k*. The end of the second guide shaft 142 projecting from the eccentric knob 8*j* constitutes a male screw part. A female screw part of the stopper 142*a* is threaded into this male screw part. Consequently, since the axial position of the second guide shaft 142 moves with the rotation to oscillate the center of the first guide shaft of the base 140, a guide hole of the guide member 140*b* provided on the base 140 is formed in a longitudinal rectangular configuration in a direction perpendicular to a line connecting the ink roller 145 and the axis of the printing type wheel 2 as shown in FIG. 18 to direct the oscillation in a direction of separating the ink roller 145 from the printing type unit 5.

The side wall 8*a* and the cover 146 is provided with a detachment ports 8*d* and 146*d* with a diameter larger than the diameter of the knob 144*a* and the ink roller 145 to enable the detachment and attachment of the ink roller 145.

The motor 149 for moving the ink roller 145 in the axial direction may be constituted so as to rotate in synchronization with the motor 82. In such a case, while the driving of the motor 82 is suspended, the motor 149 is controlled to be rotated in a reverse manner to bring back the ink roller 145 to the original position. In addition, at the time of the exchange of the printing type unit 5 and the ink roller 145, a driving signal for replacement is supplied to the motor 149 to move the ink roller 145 to the replacement position so that the driving of the motor 149 is controlled to bring back the ink roller 145 to the original position after the replacement.

Figure 21:
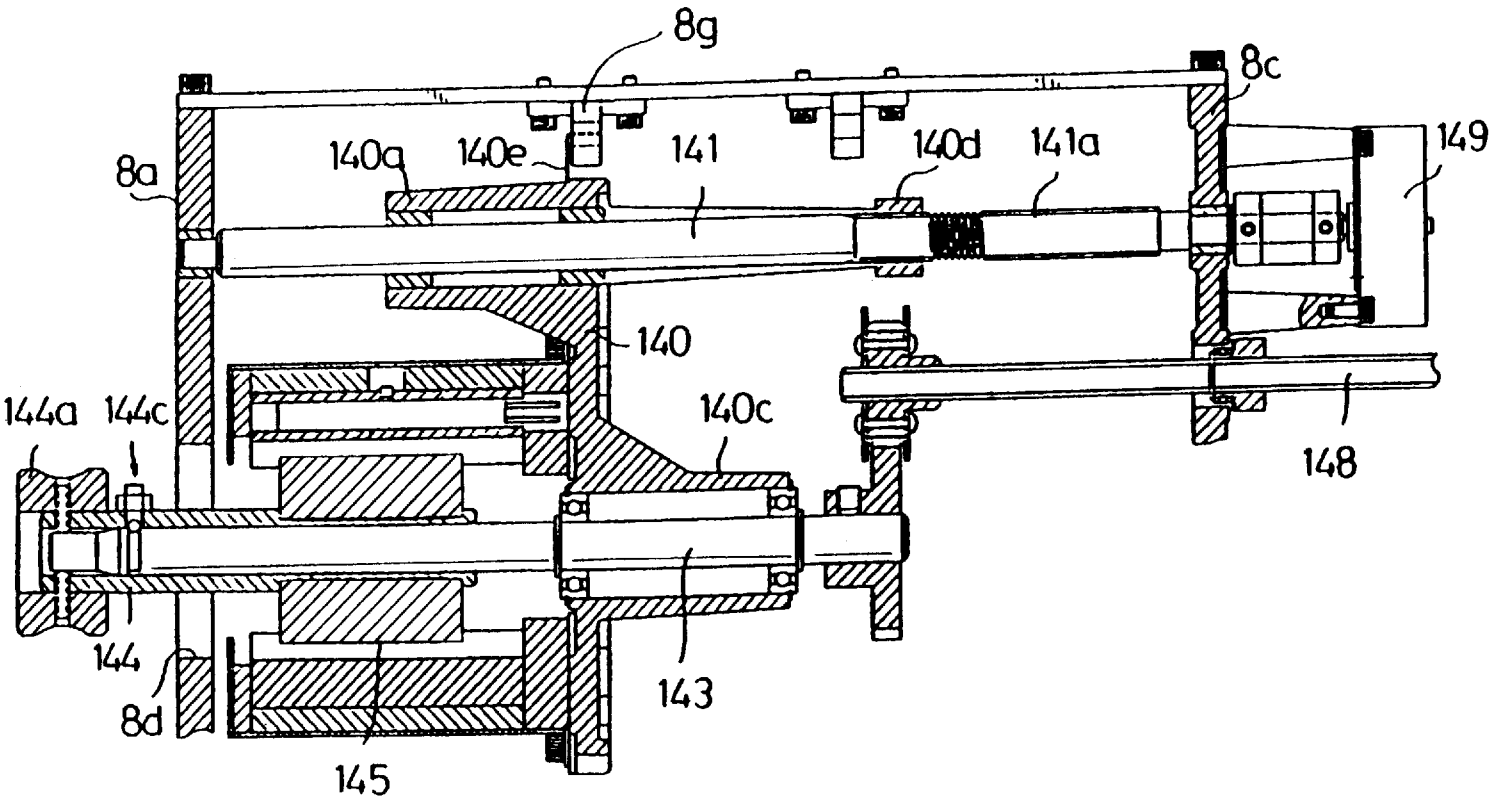
FIG. 21 is a sectional view showing a state at the time of the exchange of the printing type unit and the ink roller in FIG. 19.
Figure 22:
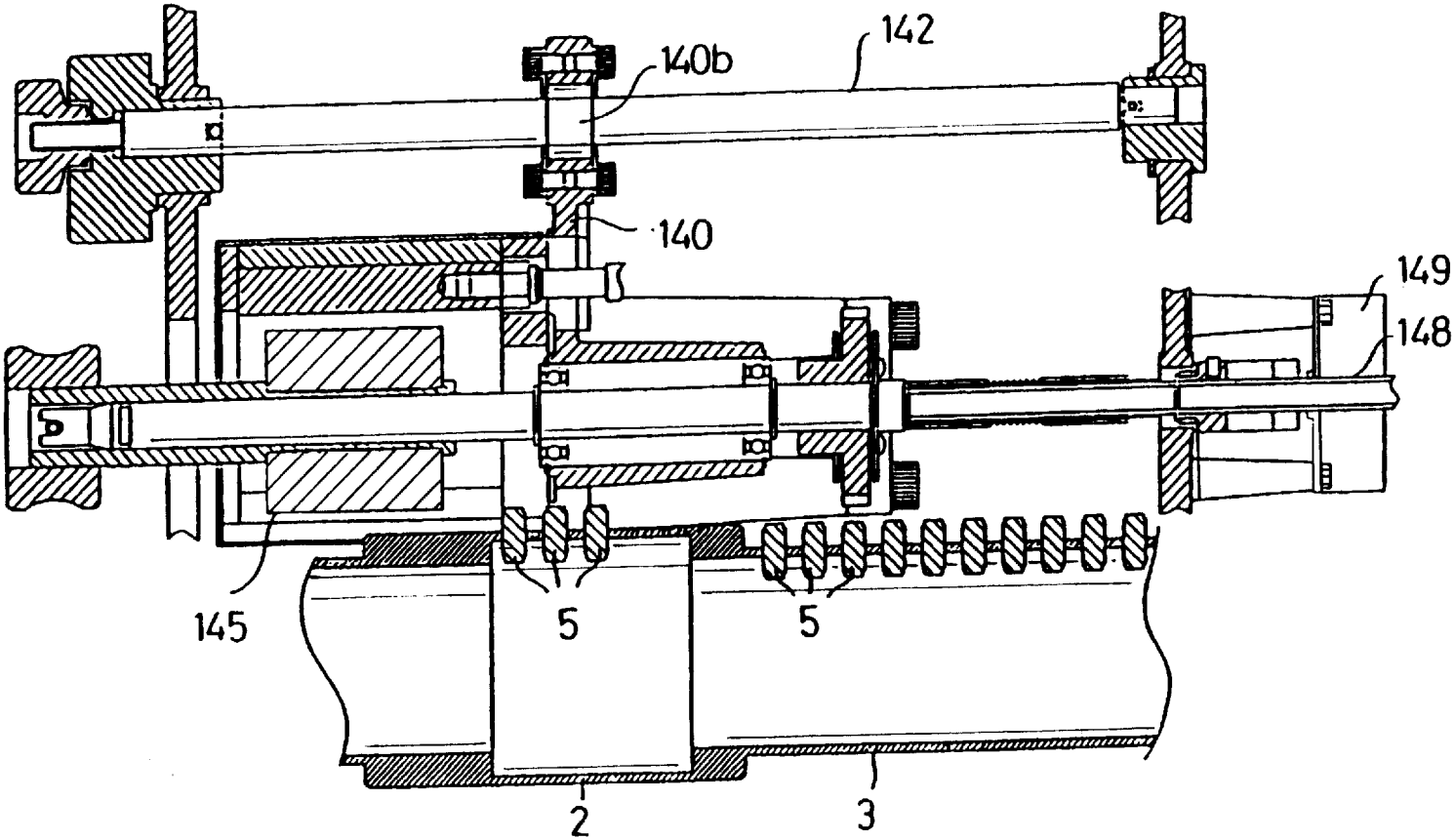
FIG. 22 is a sectional view showing a state at the time of the exchange of the printing type unit and the ink roller in FIG. 20.

In the case where the printing type unit 5 is detached from the stock wheel 3 so that it can be attached to the printing type wheel 2, the motor 149 is first driven to rotate the first guide shaft 141 to move the base 140 in the left direction as shown in FIGS. 21 and 22 with the action of the female screw 140*d* and a feed screw 141*a* thereby separating the base to a position where the ink roller 145 cannot be opposed to the printing type unit 5, for example to a position where the detection piece 140*e* is detected with a sensor 8*g*. After that, the motor 69*a* is driven to rotate the lead screw 69 to move the robot 6 to a position where the robot 6 is opposed to the stock wheel 3.

After the printing type unit 5 is attached to the printing type wheel 2, the printing type wheel 2 is brought back to the home position by driving the motor 82. Then, the motor 149 is driven to rotate the first guide shaft 141 in the opposite direction to bring back the base 140 to the home position where the detection piece 140*e* is detected with the sensor 8*f*. Next, the contact state of the ink roller 145 and the printing type unit 5 is adjusted. At this time, when the stopper 142*a* is relaxed, and the eccentric knob 8*j* is rotated to rotate the second guide shaft 142 and the eccentric bearing 8*h*, the base 140 is finely adjusted in the upper and lower direction of FIG. 6 so that the contact state of the ink roller 145 and the printing type unit 5 are finely adjusted. In this manner, the ink amount which is supplied to the printing type unit 5 is adjusted to the optimal state.

Then, at the time of printing, the package F is conveyed. When the sensor 10 detects the register mark L0 along with the conveyance of the package F, the motor 82 is excited to be set in a driving wait state. After that, every time the sensor subsequently detects the marks L1 through Ln, the motor 82 is rotated and driven through a predetermined angle. At the same time, the motor 149 is rotated and driven in synchronization with the motor 82. Driving of the motor 149 and the motor 82 at this time rotates the printing type wheel 2 one time in synchronization with the conveyance of the package F at the rotation speed identical to the conveyance speed of the package F while the sensor 10 detects the marks L1 through Ln. At the same time, the ink roller 145 is rotated in synchronization with the rotation of the printing type wheel 2 at the same rotation speed as the printing type wheel. The associated rotation of the central shaft 143 occurs via the driving shaft 148, the transmission gear 148*a* and the gear 143*a* with the rotation of the motor 82. Further, with the rotation of the motor 149, the first guide shaft 141 is rotated, the female screw 140*b* threaded into the feed screw part 141*a* is moved to the left direction of FIG. 19 so that the base 140 is moved. Then the transmission gear 148*a* follows the movement of the base 140 by sliding the driving shaft 148 in the axial direction. Consequently, the ink roller 145 is moved at a predetermined timing in the axial direction while rotating. The rotation of the printing type wheel 2 at this time causes the printing type surface 5*c* of the printing type unit 5 to contact the ink roller 145 so that the ink is deposited on the printing type surface 5*c*. After that, the ink is deposited on the package F for printing by allowing the printing type surface 5*c* to contact the package F at a position opposite to the platen 7. In the printing process, rotation or movement of the ink roller 145 in the axial direction changes the contact position of the ink roller 145 and the printing type unit 52 or the printing type unit 51 to the peripheral or the axial direction to uniformly consume the ink contained in the ink roller 145 and uniformly deposited on the surface of the printing type all the time. Thus printing by using the printing type does not generate disuniformity.

After the sensor 10 detects the mark Ln and the printing type wheel 2 is rotated once, the driving of the motors 149 and 82 is suspended. Then, the printing type wheel 2 is brought back to the original position and suspended. At the same time, the rotation of the ink roller 145 is also suspended. Then the reverse signal is supplied to the motor 149. The ink roller 145 is brought back to the home position and the movement is suspended. After that, when the sensor detects the following register mark L0 along with the conveyance of the package F, the motor 82 is excited again to be set in a driving wait state, and the following printing operation is performed in the same manner as described above.

Then, when it is required that the printing type unit 5 be replaced in the following printing operation, or when it is required that the ink roller be replaced because of the scarcity of the ink contained in the ink roller, the base 140 is moved to the left direction as shown in FIGS. 21 and 22 when the signal for replacement is supplied to the motor 149 so that the sensor 8*g* detects the detection piece 140*e* and the ink roller stops. At this position, the ink roller 145 is located at a position where the ink roller 145 does not contact the printing type unit 5. The knob 144*a* is projected from the detachment port 8*d* of the side wall 8*a*. Then, in the same manner as described above, the robot 6 is driven to replace the printing type unit 5. While the printing type unit 5 is exchanged, the printing type wheel 2 is rotated. However, since the ink roller 145 is separated, the ink is not deposited to the printing type unit 5 thereby preventing the waste of the ink. Further, when the knob 144*a* is gripped and pulled out, the knob 144*a* is separated from the central shaft 143 with the positioning member 144*c* and the ink roller 145 can be detached. Then, when the new ink roller 145 is fit to the central shaft 143, and the ink roller 145 is positioned by placing knob 144*a* back in place, the new ink roller is prevented from coming off. After that, the ink roller 145 is brought back to the home position as shown in FIGS. 19 and 20 by the driving of the motor 149.

Incidentally, the driving of the motor 149 which moves the ink roller in the axial direction is synchronized with the motor 82. However, the embodiment is not limited thereto. For example, the printing type printer may be constituted so that a driving signal is supplied to the motor 149 every time a predetermined amount of printing operation is performed and the ink roller is moved in the axial direction by a predetermined distance.

Further, as a main separation driving means, means for separating the ink roller 145 in the axial direction of the printing type wheel 2 is used. As the main separation driving means, means for separating the ink roller 145 in the radial direction thereof may also be used. In such a case, means for rotating the second guide shaft 142 is not always constituted in such a manner that the stopper 142*a* is relaxed by hands to rotate the eccentric knob 8*j*. The means may be easily constituted so that the eccentric knob 8*j* is automatically rotated and driven by using a motor.

Next, an example of another rotation control of the printing type wheel 2 will be explained on the basis of FIGS. 23 through 26.

Figure 23:
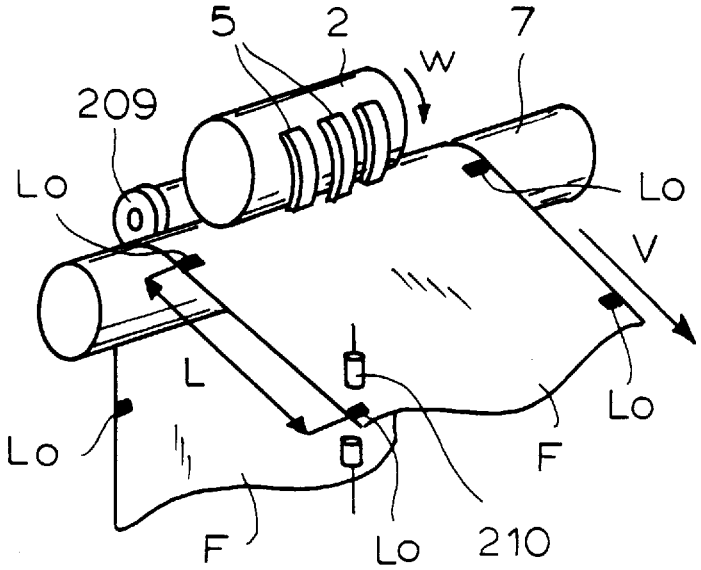
FIG. 23 is a schematic perspective view for explaining an example of an alternative rotation control of the printing type wheel.

FIG. 23 is a perspective view showing a schematic structure of an essential part of the printing type printer. In this printing type printer, the package F is conveyed with the platen 7. Then an encoder 209 which contact the platen 7 is provided to detect the conveyance speed of the package F on the basis of the rotation of the platen 7. Further, a sensor 210 for detecting the register mark L0 of the package F is provided. The position at which the sensor 210 detects the register mark L0 is set as the initial position of the printing type wheel 2. When the sensor 210 detects the register mark L0, a driving signal is supplied to the motor 82 to rotate and drive the printing type wheel 2.

Figure 24:
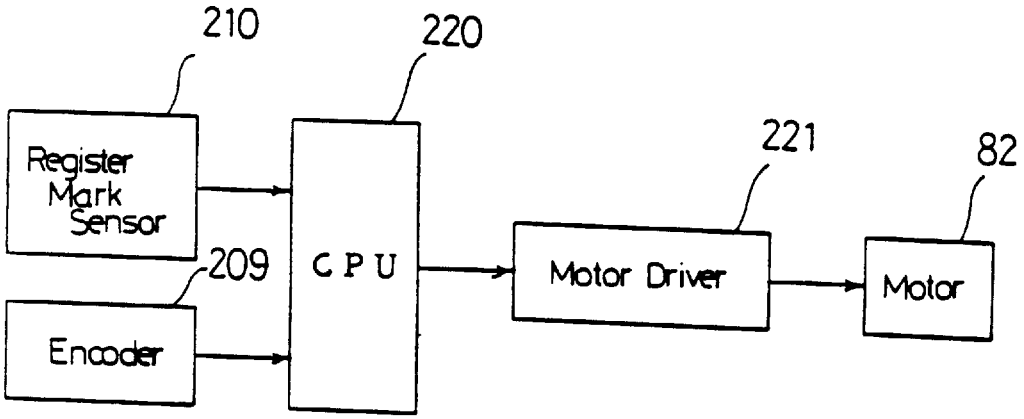
FIG. 24 is a block view of a rotation driving means in the printing type wheel of FIG. 23.

As shown in FIG. 24, the output of the sensor 210 which detects the register mark L0 is supplied to the control means (CPU) 220 and the output based on the conveyance speed V of the package F which is detected by the encoder 209 is also supplied to the CPU 220. Then when the output of the sensor 210 is supplied to the CPU 220, a motor driving signal with an angle velocity of W1 which signal is controlled by the CPU 220 and is synchronized with the conveyance speed V from the motor driver 221 is supplied to the motor 82.

Figure 25:
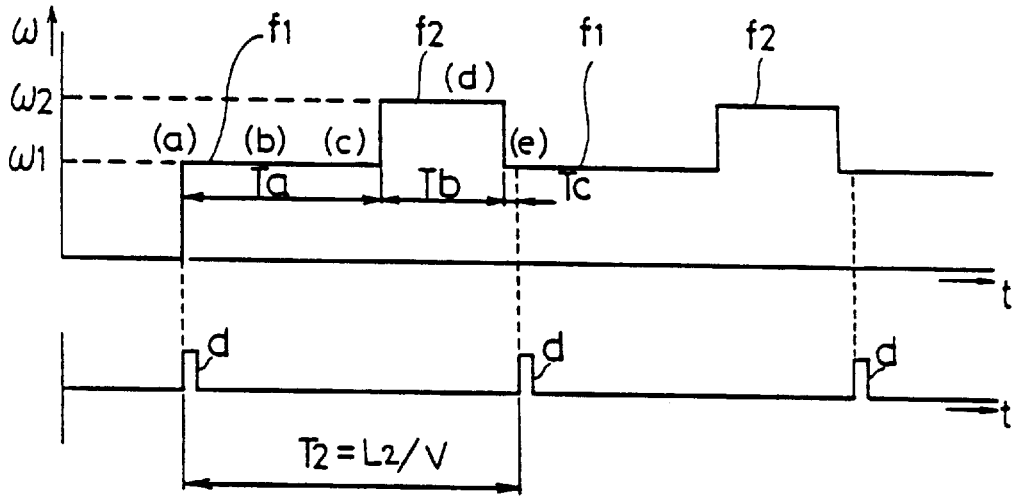
FIG. 25 is one example of a signal waveform view for rotating and driving the printing type wheel of FIG. 23.

As shown in FIG. 25, when the sensor 210 detects the register mark L0 and the detection signal d is supplied to the CPU 220, the motor driving signal f1 with an angle velocity of W1 which synchronizes with the conveyance speed V of the package F is supplied to the motor driver 221 from the CPU 220. Then the printing type wheel 2 starts to rotate at an angle velocity W1. Since the angle velocity W1 is set to synchronize with the conveyance speed V, the printing type unit 5 prints characters and symbols in contact with the package F. During this time, both the printing type unit 5 and the package F moves at the same speed to print good-quality characters and symbols. When the rotation angle is set to 180 degrees, time Ta which is required for the rotation of the rotation angle of 180 degrees is half of the time Th which is required for the printing type wheel 2 to rotate once at the same speed with the result that the equation of Ta=Th/2 is established. Since the time T2 required for the package F to be conveyed in a printing pitch is given as T2=L2/V wherein L2 represents the printing pitch, the remaining time Tb used for the rotation is given as Tb=T2-Ta-Tc when the printing type wheel 2 is brought back to the initial position with a little residual time of Tc. For example, the residual time Tc is set as about Tc=0.1 sec. Within this time Tb, a larger difference between the circumferential length Dπ and the printing pitch L2 may be taken into consideration. Assuming that the printing type wheel is rotated with no consideration of the speed adjustment, the angle velocity W2 of the printing type wheel at this time is represented by the following equation:

$$(w2-w1)\cdot D/2\cdot Tb=D\pi-L2$$

The speed may be accelerated to the following speed.

$$w2=w1+(D\pi-L2)\cdot 2/D\cdot 1/Tb$$

In other words, when the driving signal f1 of the angle velocity W1 is supplied to the motor driver 221 from the CPU220 and time Ta has passed, a driving signal f2 of the angle velocity W2 is supplied to the motor driver 22 from the CPU 220. Then when the printing type wheel starts to rotate at an angle velocity of W2 and time Tb has passed, the driving signal f1 of the angle velocity W1 is supplied again to the motor driver 221 from the CPU 220 so that the printing type wheel 2 starts to rotate again at an angle velocity of W1. When time Tc has passed, the sensor 10 detects the following register mark 10 and the detection signal d is supplied to the CPU 20. Consequently, the aforementioned operation will be repeated.

In this embodiment, the circumferential length Dπ of the printing type wheel 2 is larger than the printing pitch L2. In this case, the angle velocity W2 is set to a speed greater than the angle speed 11 so as to rotate the printing type wheel 2 at a high speed. However, the embodiment of the invention is not limited thereto. In the case where the circumferential length Dπ of the printing type wheel 2 is smaller than the printing pitch L2, the angle velocity W2 is set to a level smaller than the angle velocity W1 so that the printing type wheel 2 may be rotated at a low speed. In this manner, the printing pitch may be set to any printing pitch L2 regardless of the circumferential length of the printing type wheel 2. Thus, the printing type wheel 2 can be continuously rotated.

While the printing type wheel 2 is rotated continuously by changing the speed of rotation without suspending the printing type wheel 2, characters and symbols can be printed correctly at a predetermined position on the package F. Then product information is printed on a package F and sent to a packaging machine not shown which cuts the packaging at the register mark L0.

What is claimed is:

1. A printing type printer comprising a printing type wheel provided with a printing type attachment part having at least one detachable printing type unit for printing characters and symbols on a matter to be printed, a stock wheel for detachably stocking said printing type unit attached on said printing type wheel, and a robot which attaches said printing type unit on said printing type wheel by taking out said printing type unit from said stock wheel.

2. A printing type printer according to claim 1 wherein said printing type wheel and said stock wheel are coaxially arranged.

3. A printing type printer according to claim 2 wherein said printing type wheel and said stock wheel are integrally arranged.

4. A printing type printer according to claim 1 wherein said printing type wheel and said stock wheel are sectioned and arranged on the circumferential surface of the same wheel.

5. A printing type printer according to claim 1 wherein said printing type wheel is provided with a printing type attachment part attached with a perpendicular typing printing type unit for printing characters and symbols in a direction perpendicular to the conveyance direction of the matter to be printed.

6. A printing type printer according to claim 2 wherein said printing type wheel is provided with a printing type attachment part attached with a perpendicular typing printing type unit for printing characters and symbols in a direction perpendicular to the conveyance direction of the matter to be printed.

7. A printing type printer according to claim 3 wherein said printing type wheel is provided with a printing type attachment part attached with a perpendicular typing printing type unit for printing characters and symbols in a direction perpendicular to the conveyance direction of the matter to be printed.

8. A printing type printer according to claim 4 wherein said printing type wheel is provided with a printing type attachment part attached with a perpendicular typing printing type unit for printing characters and symbols in a direction perpendicular to the conveyance direction of the matter to be printed.

9. A printing type printer according to claim 1 wherein said printing type wheel is provided with a printing type attachment part attached with a printing type unit for a flow printing of characters and symbols in a direction parallel to the conveyance direction of the matter to be printed.

10. A printing type printer according to claim 2 wherein said printing type wheel is provided with a printing type attachment part attached with a printing type unit for a flow printing of characters and symbols in a direction parallel to the conveyance direction of the matter to be printed.

11. A printing type printer according to claim 3 wherein said printing type wheel is provided with a printing type attachment part attached with a printing type unit for a flow printing of characters and symbols in a direction parallel to the conveyance direction of the matter to be printed.

12. A printing type printer according to claim 4 wherein said printing type wheel is provided with a printing type attachment part attached with a printing type unit for a flow printing of characters and symbols in a direction parallel to the conveyance direction of the matter to be printed.

13. A printing type printer according to claim 1 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

14. A printing type printer according to claim 2 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

15. A printing type printer according to claim 3 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

16. A printing type printer according to claim 4 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

17. A printing type printer according to claim 5 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

18. A printing type printer according to claim 6 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

19. A printing type printer according to claim 7 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

20. A printing type printer according to claim 8 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

21. A printing type printer according to claim 9 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

22. A printing type printer according to claim 10 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

23. A printing type printer according to claim 11 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

24. A printing type printer according to claim 12 wherein a main body of said printing type unit comprises a thrust part exposed from said printing type attachment part, an insertion part inserted into said printing type attachment part, a printing type surface of characters and symbols to be printed are provided on top part of said thrust part, a gripping part for detachably attaching said printing type unit on said printing type attachment part, a housing part for housing a holding means for engaging and holding said printing type unit in the printing type attachment part inside of said main body, and said holding means comprising an engagement part engaged in said printing type attachment part and a spring member for energizing said engagement part in an engagement direction with said printing type attachment part.

25. A printing type printer according to claim 17 wherein an engagement part of said holding means comprises an engagement projecting part which is provided projectingly to an outward direction in an intermediate part of a pair of engagement pieces located opposite to each other at a predetermined gap, a recessed part on an opposite surface of the intermediate part of said engagement piece, spring member which is positioned and held in the recessed part so as to energize said pair of engagement pieces in a repelling direction, an operation projecting part which can receive pressure from the outside in said gripping part on the upper end of said engagement piece, and an oscillation central part is provided on the lower end of said engagement piece when said engagement piece is oscillated upon said operation projecting part receiving said pressure force.

26. A printing type printer according to claim 21 wherein an engagement part of said holding means comprises an engagement projecting part which is provided projectingly to an outward direction in an intermediate part of a pair of engagement pieces located opposite to each other at a predetermined gap, a recessed part on an opposite surface of the intermediate part of said engagement piece, a spring member which is positioned and held in the recessed part so as to energize said pair of engagement pieces in a repelling direction, an operation projecting part which can receive pressure from the outside in said gripping part on the upper end of said engagement piece and an oscillation central part is provided on the lower end of said engagement piece when said engagement piece is oscillated upon said operation projecting part receiving said pressure force.

27. A printing type printer according to claim 17 wherein an engagement part of said holding means comprises an engagement hook which projects outward on a lower end of a pair of engagement pieces slidably supported at the intermediate part, a central shaft in which said engagement piece can oscillate, an operation projecting part which can receive pressure from the outside in said gripping part on an upper end of said engagement pieces, a said spring member which is fit and supported in said central shaft, and said pair of engagement hooks are energized in a repelling direction.

28. A printing type printer according to claim 21 wherein an engagement part of said holding means comprises an engagement hook which projects outward on a lower end of a pair of engagement pieces slidably supported at the intermediate part, a central shaft in which said engagement piece can oscillate, an operation projecting part which can receive pressure from the outside in said gripping part on an upper end of said engagement pieces, a said spring member which is fit and supported in said central shaft, and said pair of engagement hooks are energized in a repelling direction.

29. A printing type printer according to claim 17 wherein an engagement part of said holding means comprises engagement projecting parts projectingly deflected in opposite directions of each other, a spring member in which both ends of said spring member are hooked on a regulating piece projectingly provided on the upper end of said housing chamber, a winding part, in the middle of said spring member which is fit and supported in the shaft part projectingly provided on the lower end of said housing chamber, and said pair of engagement projecting parts are energized in a repelling direction.

30. A printing type printer according to claim 21 wherein an engagement part of said holding means comprises engagement projecting parts projectingly deflected in opposite directions of each other, a spring member in which both ends of said spring member are hooked on a regulating piece projectingly provided on the upper end of said housing chamber, a winding part, in the middle of said spring member which is fit and supported in the shaft part projectingly provided on the lower end of said housing chamber, and said pair of engagement projecting parts are energized in a repelling direction.

31. A printing type printer according to claim 1 in which an ink roller for supplying ink to said printing type unit attached on said printing type wheel and movement driving means for moving said ink roller in parallel to the axial direction of said printing type wheel are provided.

32. A printing type printer according to claim 31 wherein a detachment port which enables the detachment of said ink roller is provided on a support plate opposite to one end of said ink roller.

33. A printing type printer according to claim 31 wherein said movement driving means is driven in synchronization with the rotation driving means of said printing type wheel.

34. A printing type printer according to claim 32 wherein said movement driving means is driven in synchronization with the rotation driving means of said printing type wheel.

35. A printing type printer according to claim 1 in which an ink roller for supplying ink to said printing type unit attached on said printing type wheel and a separation driving means for separating said ink roller from said printing type unit at the time of the exchange of said printing type unit are provided.

36. A printing type printer according to claim 35 wherein said separation driving means separates said ink roller in the axial direction of said printing type wheel.

37. A printing type printer according to claim 35 wherein said separation driving means separates said ink roller in the radial direction of said printing type wheel.

38. A printing type printer according to claim 35 wherein said separation driving means changes the position of contact of said printing type unit and said ink roller at the time of printing said object to be printed.

39. A printing type printer according to claim 36 wherein said separation driving means moves said ink roller to a predetermined position at the time of the exchange of the ink roller.

40. A printing type printer according to claim 38 wherein said separation driving means moves said ink roller to a predetermined position at the time of the exchange of the ink roller.

41. A printing type printer according to claim 1 wherein control means is provided for controlling the rotation driving means of said printing type wheel so that while said printing type unit contacts said matter to be printed, said printing type wheel rotates in synchronization with the conveyance speed of said matter to be printed and said printing type wheel continuously rotates at a speed either faster or slower than the conveyance speed of said matter to be printed in a state in which said printing type unit is separate from said object to be printed.

42. A printing type printer according to claim 31 wherein control means is provided for controlling the rotation driving means of said printing type wheel so that while said printing type unit contacts said object to be printed, said printing type wheel rotates in synchronization with the conveyance speed of said object to be printed and said printing type wheel continuously rotates at a speed either faster or slower than the conveyance speed of said object to be printed in a state in which said printing type unit is separate from said object to be printed.

43. A printing type printer according to claim 32 wherein control means is provided for controlling the rotation driving means of said printing type wheel so that while said printing type unit contacts said object to be printed, said printing type wheel rotates in synchronization with the conveyance speed of said object to be printed and said printing type wheel continuously rotates at a speed either faster or slower than the conveyance speed of said object to be printed in a state in which said printing type unit is separate from said object to be printed.

44. A printing type printer according to claim 33 wherein control means is provided for controlling the rotation driving means of said printing type wheel so that while said printing type unit contacts said object to be printed, said printing type wheel rotates in synchronization with the conveyance speed of said object to be printed and said printing type wheel continuously rotates at a speed either faster or slower than the conveyance speed of said object to be printed in a state in which said printing type unit is separate from said object to be printed.

45. A printing type printer according to claim 34 wherein control means is provided for controlling the rotation driving means of said printing type wheel so that while said printing type unit contacts said object to be printed, said printing type wheel rotates in synchronization with the conveyance speed of said object to be printed and said printing type wheel continuously rotates at a speed either faster or slower than the conveyance speed of said object to be printed in a state in which said printing type unit is separate from said object to be printed.

46. A printing type printer according to claim 35 wherein control means is provided for controlling the rotation driving means of said printing type wheel so that while said printing type unit contacts said object to be printed, said printing type wheel rotates in synchronization with the conveyance speed of said object to be printed and said printing type wheel continuously rotates at a speed either faster or slower than the conveyance speed of said object to be printed in a state in which said printing type unit is separate from said object to be printed.

47. A printing type printer according to claim 36 wherein control means is provided for controlling the rotation driving means of said printing type wheel so that while said printing type unit contacts said object to be printed, said printing type wheel rotates in synchronization with the conveyance speed of said object to be printed and said printing type wheel continuously rotates at a speed either faster or slower than the conveyance speed of said object to be printed in a state in which said printing type unit is separate from said object to be printed.

48. A printing type printer according to claim 37 wherein an engagement part of said holding means comprises an engagement hook which projects outward on a lower end of a pair of engagement pieces slidably supported at the intermediate part, a central shaft in which said engagement piece can oscillate, an operation projecting part which can receive pressure from the outside in said gripping part on an upper end of said engagement pieces, a said spring member which is fit and supported in said central shaft, and said pair of engagement hooks are energized in a repelling direction.

49. A printing type printer according to claim 38 wherein an engagement part of said holding means comprises an engagement hook which projects outward on a lower end of a pair of engagement pieces slidably supported at the intermediate part, a central shaft in which said engagement piece can oscillate, an operation projecting part which can receive pressure from the outside in said gripping part on an upper end of said engagement pieces, a said spring member which is fit and supported in said central shaft, and said pair of engagement hooks are energized in a repelling direction.

50. A printing type printer according to claim 39 wherein an engagement part of said holding means comprises an engagement hook which projects outward on a lower end of a pair of engagement pieces slidably supported at the intermediate part, a central shaft in which said engagement piece can oscillate, an operation projecting part which can receive pressure from the outside in said gripping part on an upper end of said engagement pieces, a said spring member which is fit and supported in said central shaft, and said pair of engagement hooks are energized in a repelling direction.

51. A printing type printer according to claim 40 wherein an engagement part of said holding means comprises an engagement hook which projects outward on a lower end of a pair of engagement pieces slidably supported at the intermediate part, a central shaft in which said engagement piece can oscillate, an operation projecting part which can receive pressure from the outside in said gripping part on an upper end of said engagement pieces, a said spring member which is fit and supported in said central shaft, and said pair of engagement hooks are energized in a repelling direction.

52. A printing type printer according to claim 13 wherein an engagement part of said holding means comprises an engagement projecting part which is provided projectingly to an outward direction in an intermediate part of a pair of engagement pieces located opposite to each other at a predetermined gap, a recessed part on an opposite surface of the intermediate part of said engagement piece, spring member which is positioned and held in the recessed part so as to energize said pair of engagement pieces in a repelling direction, an operation projecting part which can receive pressure from the outside in said gripping part on the upper end of said engagement piece, and an oscillation central part is provided on the lower end of said engagement piece when said engagement piece is oscillated upon said operation projecting part receiving said pressure force.

53. A printing type printer according to claim 13 wherein an engagement part of said holding means comprises an engagement hook which projects outward on a lower end of a pair of engagement pieces slidably supported at the intermediate part, a central shaft in which said engagement piece can oscillate, an operation projecting part which can receive pressure from the outside in said gripping part on an upper end of said engagement pieces, a said spring member which is fit and supported in said central shaft, and said pair of engagement hooks are energized in a repelling direction.

54. A printing type printer according to claim 13 wherein an engagement part of said holding means comprises engagement projecting parts projectingly deflected in opposite directions of each other, a spring member in which both ends of said spring member are hooked on a regulating piece projectingly provided on the upper end of said housing chamber, a winding part, in the middle of said spring member which is fit and supported in the shaft part projectingly provided on the lower end of said housing chamber, and said pair of engagement projecting parts are energized in a repelling direction.

55. A printing type printer according to claim 1 wherein said printing type wheel and said stock wheel are provided as a printing type wheel part and a stock wheel part sectioned and arranged on the circumferential surface of the same wheel.

56. A printing type printer according to claim 55 wherein said printing type wheel part is provided with a printing type attachment part attached with a perpendicular typing printing type unit for printing characters and symbols in a direction perpendicular to the conveyance direction of the object to be printed.

57. A printing type printer according to claim 55 wherein said printing type wheel part is provided with a printing type attachment part attached with a flow typing printing type unit for printing characters and symbols in a direction parallel to the conveyance direction of the object to be printed.

58. A printing type printer according to claim 55 wherein a printing surface of a first printing type unit attached on said printing type wheel part is in a radially raised position relative to a printing surface of a second printing type unit attached on said stock wheel part.

59. A printing type printer according to claim 56 wherein a printing surface of a first printing type unit attached on said printing type wheel part is in a radially raised position relative to a printing surface of a second printing type unit attached on said stock wheel part.

60. A printing type printer according to claim 57 wherein a printing surface of a first printing type unit attached on said printing type wheel part is in a radially raised position relative to a printing surface of a second printing type unit attached on said stock wheel part.

* * * * *